United States Patent [19]

Borys

[11] 3,945,157

[45] Mar. 23, 1976

[54] PREFABRICATED WALL ELEMENTS

[76] Inventor: Zdzislaw Borys, 38 Sudley Road, Bognor Regis, Sussex, England

[22] Filed: Feb. 28, 1974

[21] Appl. No.: 447,028

Related U.S. Application Data

[63] Continuation of Ser. No. 176,210, Aug. 30, 1971, which is a continuation-in-part of Ser. No. 760,196, Sept. 17, 1968, abandoned.

[30] Foreign Application Priority Data

Sept. 11, 1970 United Kingdom ..... 43643/70

[52] U.S. Cl. ..... 52/36; 52/79; 52/292

[51] Int. Cl.[2] ..... E04B 1/348

[58] Field of Search ..... 52/79, 125, 122, 143, 36, 52/220, 221, 292; 217/12 R

[56] References Cited

UNITED STATES PATENTS

| | | | |
|---|---|---|---|
| 2,877,508 | 3/1959 | Ewart | 52/125 |
| 3,273,738 | 9/1966 | Blanco | 217/12 R |
| 3,289,382 | 12/1966 | Van Der Lely | 52/122 |

FOREIGN PATENTS OR APPLICATIONS

| | | | |
|---|---|---|---|
| 1,406,672 | 6/1965 | France | 52/79 |

*Primary Examiner*—John E. Murtagh
*Attorney, Agent, or Firm*—Holman & Stern

[57] ABSTRACT

A room or like portion of a building, or a complete building, comprises two rectangular tray-like wall elements, at least one inverted tray-like ceiling element, and strip-like floor and wall elements, comprising load-bearing frameworks with cladding. The walltray elements incorporate furniture, fixtures and fittings and together, possibly with others of the elements, form a container of standard size for transportation. The frameworks are provided with lifting eyes which also serve for interconnecting the elements when assembled to form a room or building. Further elements for forming corridor floors and ceilings, cladding, foundation units incorporating service ducting are also transported in containerized arrangements. The wall trays may incorporate telescopic services connections for interconnecting adjacent rooms in a building. Also described are similar containerized forms of elevators, staircases, plant and machinery rooms. The wall trays may be arranged with their lengths horizontal, or vertical to form low, e.g. two or three-story, dwellings.

2 Claims, 55 Drawing Figures

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORY
BY

INVENTOR
ZDZISLAW BORYS
BY

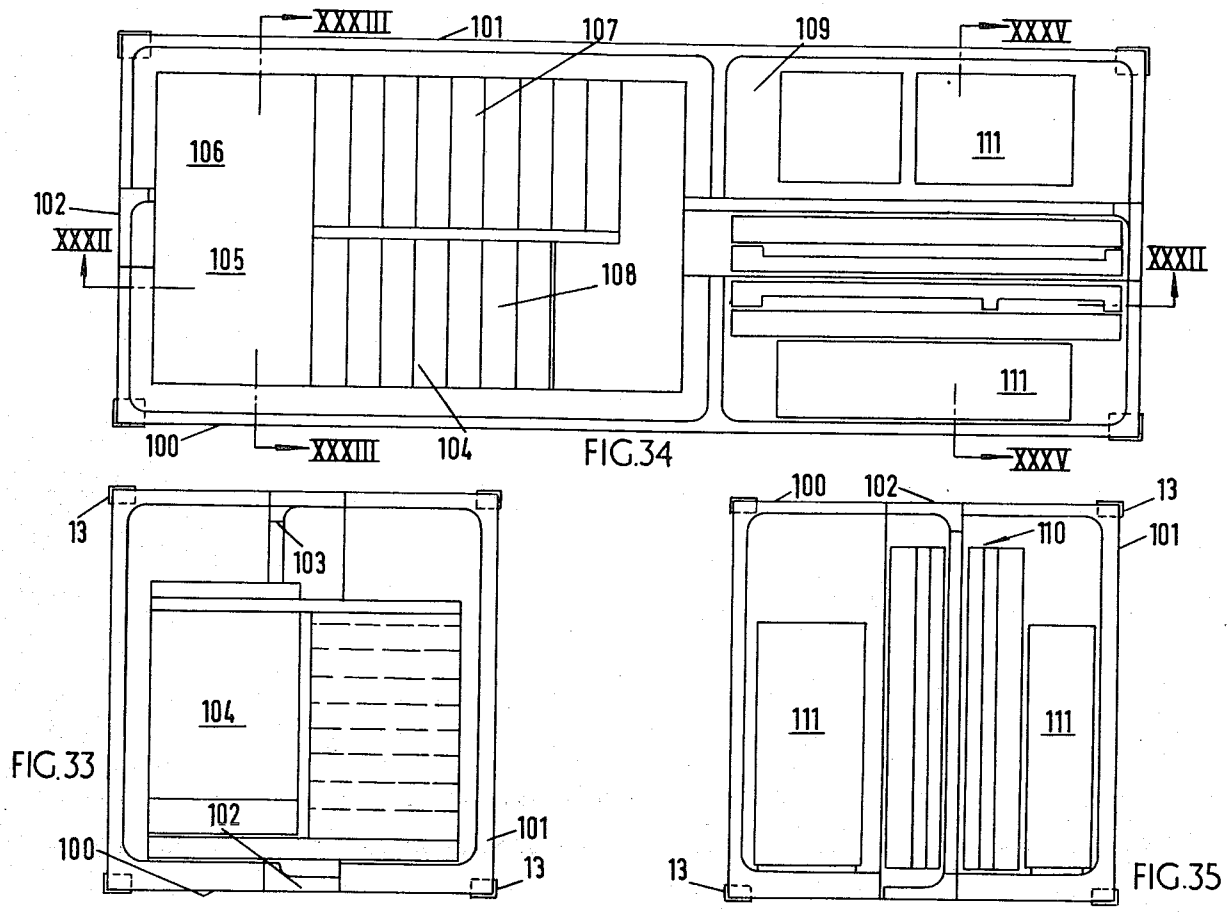
INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORYS
BY

INVENTOR
ZDZISLAW BORY
BY

INVENTOR
ZDZISLAW BORYS
BY

INVENTOR
ZDZISLAW BORYS
BY

PREFABRICATED WALL ELEMENTS

This is a continuation of application Ser. No. 176,210 filed Aug. 30, 1971 which in turn is a continuation-in-part of Ser. No. 760,196 filed Sept. 17, 1968, now abandoned.

BACKGROUND OF THE INVENTION

This invention relates to buildings and has especial but not exclusive reference to hotel and apartment buildings.

PRIOR ART

The use of prefabrication in building construction is well known. However, when only walls and the like are prefabricated, much site work is still needed to install sanitary and other fittings and decorations; if these are factory-installed, there is a serious risk of damage during transport to the side unless elaborate and expensive protection is provided. Pre-molded plastic bathrooms and the like have been proposed, but these also need protection, and have to be fitted into some form of structural frame on site. French Patent No. 1406672 to Lemarignier discloses a transportable cabin but fittings, furniture and services all need to be installed at the site and therefore need separate transport and protection; the cabin of Lemarignier is furthermore incapable of use as an element of a building.

OBJECTS AND SUMMARY OF THE INVENTION

It is an object of the invention largely to eliminate site work in building erection, without incurring the need for expensive protection during transportation of prefabricated elements.

According to the invention, I provide a room unit comprising prefabricated load-bearing rectangular tray-like wall elements adapted to form together a rectangular container and to form with further prefabricated elements, a room (or a plurality of rooms e.g. a bedroom and bathroom en suite..

Each of the wall elements is in the form of an open box or tray so that two of the elements when fitted together form a closed rectangular container in which are packed furniture and fittings and possibly the further elements; the latter, at the building site, are placed between the first-mentioned wall elements to form a complete room unit. Thus, the total volume of the container and the room's contents is substantially less than that of the room when erected and transport costs are much reduced; in effect, it is no longer necessary to transport the empty space within the room and a greater number of room units can be transported in a given space.

In one preferred arrangement, the elements forming the container constitute two opposite walls together with small parts of the floor, ceiling, and other walls adjacent to the walls. Beds, chairs, baths, washbasins, and other furniture and fittings are factory-fitted to the walls, and the room unit is completed by strip-like further elements forming the central parts of the floor and ceiling, a window wall, and a doorway.

The room unit is capable of acting as a structural element of a building in which it is incorporated; it may be made of e.g. glass fiber reinforced plastic with load-carrying metal reinforcement.

The length and width of the container may vary according to requirements. The maximum height of the container which is dictated by international agreement, should not exceed 2.44 m. (8 feet). This means that internally the height of a tray is reduced to 2.24 m. (7 feet 4 inches). However, the ceiling tray permits an increase in height of the room virtually up to 4.48 m (14 feet 8 inches).

The building itself may comprise a core or spine with services, including access elevators and/or stairs, to which the room units are attached. The room units may incorporate sanitary equipment or some or all of the latter may be provided in separate capsules e.g. made of glass fiber reinforced plastics and also attached to the core or spine. The room units may be assembled with each other by stacking, or by means of cantilevered brackets, or by being inserted into a previously prepared structure; they may themselves form the entire or substantially the entire load-bearing part of the building.

The wall elements may be used as load-bearing self-standing elements, being spanned by the floor and ceiling elements; in the preferred construction, the metal inserts of the wall elements carry the load.

My room unit has many advantages; it saves transport costs by virtue of its small transport volume compared with the completed room, simplifies construction and eliminates the need of scaffolding since it is a structural unit, does not require any return transport for the container since the latter is used as part of the building, and reduces transport costs and breakages in the case of furniture and fittings since these can be transported in the container which will fully protect them. Plumbing, electrical installations, decorations, and the like can be provided before transportation to the site.

The invention is illustrated by the drawings accompanying this Specification, in which:

BRIEF DESCRIPTION OF THE DRAWINGS

FIG. 33 is a cross-section on line XXXIII—XXXIII of FIG. 34;

FIG. 34 is a plan in cross-section;

FIG. 35 is a cross-section on line XXXV—XXXV of FIG. 34;

DETAILED DESCRIPTION OF THE EMBODIMENTS

Figure 1:
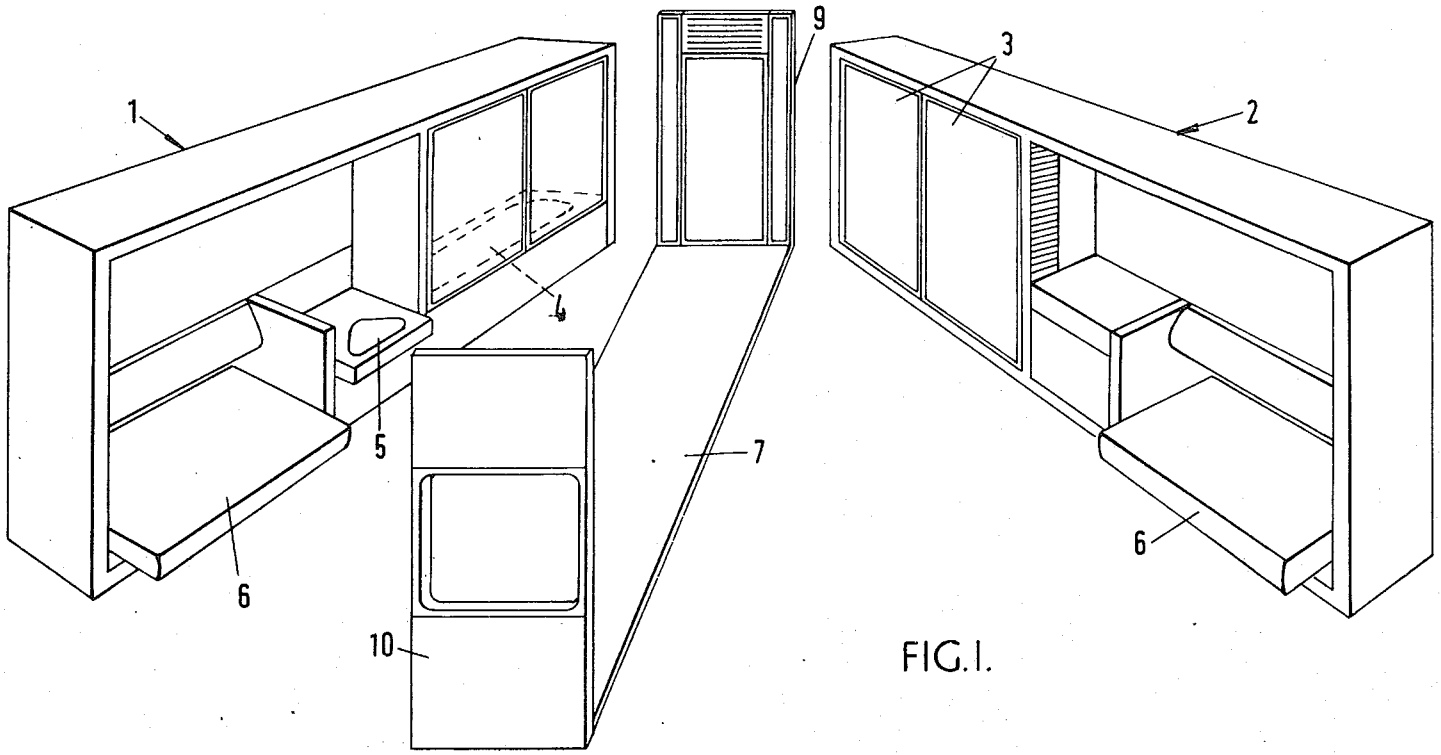
FIG. 1 is an exploded view of part of a room according to a first embodiment of the invention.
Figure 2:
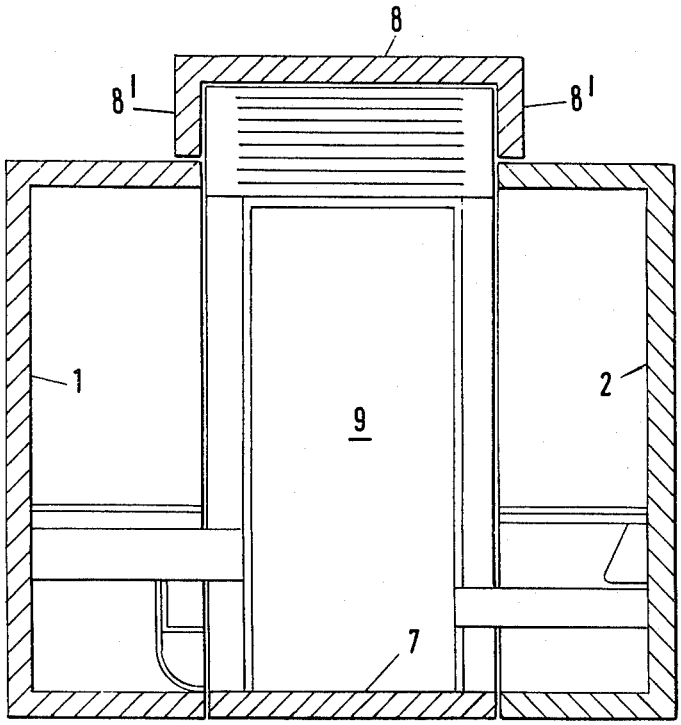
FIG. 2 is a cross-section of the complete room.
Figure 3:
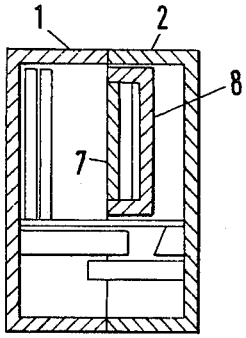
FIG. 3 is a cross-section of the room, collapsed for transport.
Figure 4:
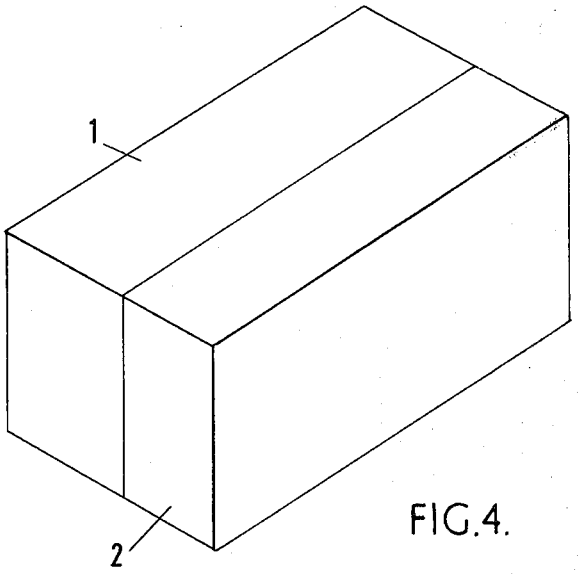
FIG. 4 is a perspective view of the room, collapsed for transport.

FIGS. 1 to 4 illustrate a first embodiment. Two tray-like windowless side wall elements or trays 1, 2 are fitted in the factory with cupboards 3, bath 4, basin 5, and retractable bed-settees 6. Decorations and all plumbing and electrical fittings are provided in the factory. For transport to the building site, the elements are fastened face to face e.g. as in FIGS. 3 (in section) and 4 (perspective) to form a very strong closed container with items 3 to 6 within. Also inside the container are a floor element 7, a ceiling element or tray 8, a doorway element 9 and a window element 10. On site the container is opened, and elements 7 to 10 are fitted between elements 1 and 2 to form a bedroom, as indicated in section in FIG. 2 and in exploded view in FIG. 1. The volume of the container (FIGS. 3 and 4) can be as little as half that of the assembled room unit.

Elements 9 and 10 are higher than elements 1 and 2, element 8 being therefore provided with vertical walls 8'; this arrangement gives a greater reduction in volume for transport, and the spaces above elements 1 and 2 in the assembled unit can be used e.g to accommodate cantilever brackets for supporting the room units on a service core, or service ducts or air-conditioning ducts.

Further facilities, e.g. water closet and bidet, may be provided in the room unit or in separate capsules also attached to the core, which may also contain elevator shafts and access passages to the room units; air-conditioning ducts may be provided above the access passages.

During building construction, the room units and capsules if used, are delivered to the site, where they are simply stacked on one another or connected to a service core already constructed.

Of course, various sizes and internal arrangements of the room units are possible, to provide bed-, sitting- and dining-rooms of various sizes, but the maximum benefit of my system is obtained if all room units have the same cross-section and have the door at one end and a window at the other end. By selecting units of different lengths, however, the building as a whole can be given an interesting "textured" appearance, since the units will project to different extents from the core.

Figure 5:
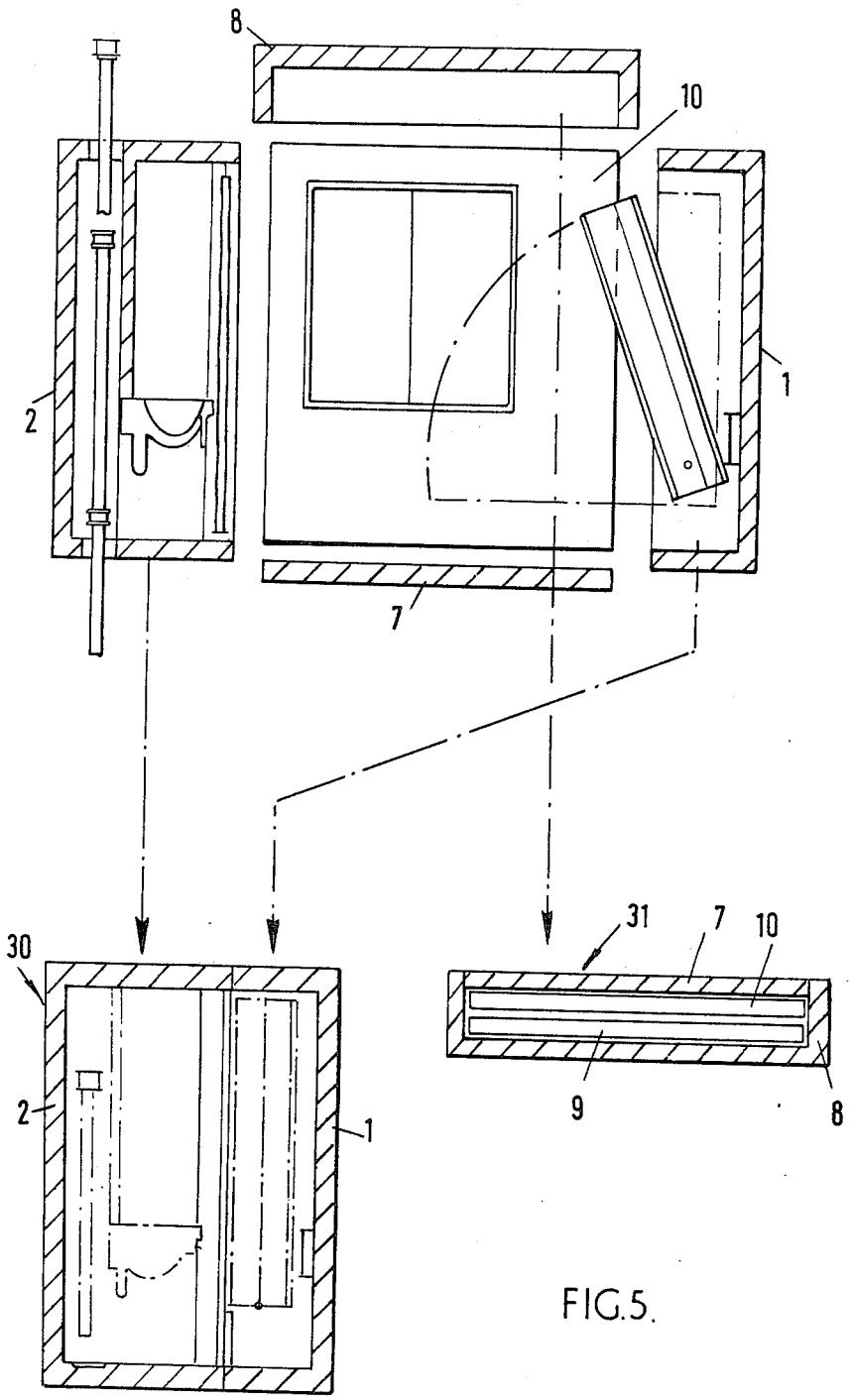
FIG. 5 is an exploded view illustrating a room similar to FIG. 1 but arranged differently for transport.

The room shown in FIG. 5 has elements 1, 2, 7, 8, 9 and 10 similar to those of FIG. 1. However, for transport, these constitute two containers. A larger container 30 consists of the wall trays 1 and 2, containing the furniture and fittings. A smaller container 31 consists of the ceiling tray 8 and floor element 7 and contains the end wall elements 9 and 10, provided with a door and a window. In a further possible arrangement, ceiling elements of two separate room units form one of the containers.

The smaller container can be placed side by side with, or between the wall elements forming the larger container 30 so as to form an assembly whose overall dimensions are those of the international standard container viz 8 feet square in cross-section.

Figure 6:
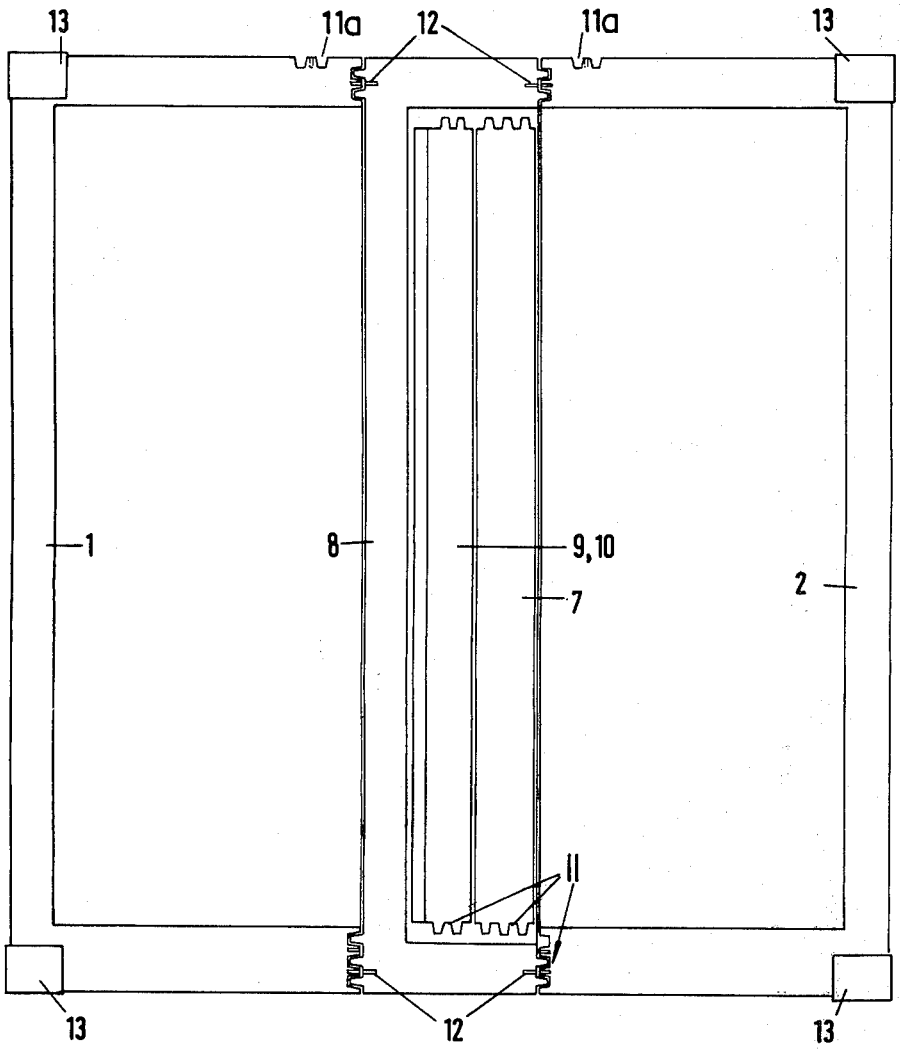
FIG. 6 is a cross-section of a containerized room as in FIG. 5, on a larger scale.
Figure 7:
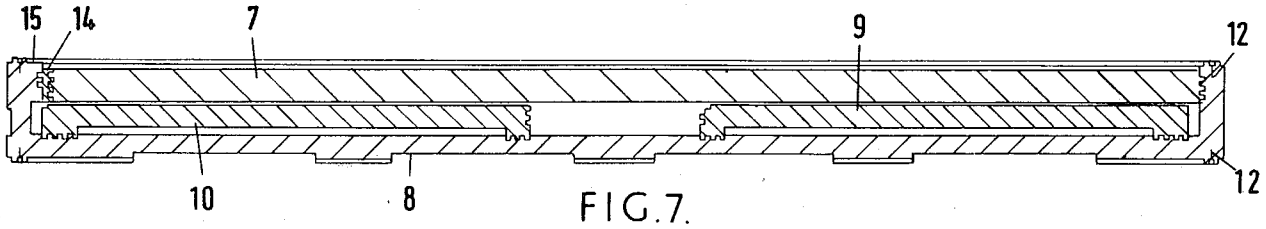
FIG. 7 is a longitudinal section of part of the containerized room of FIG. 6.
Figure 8:
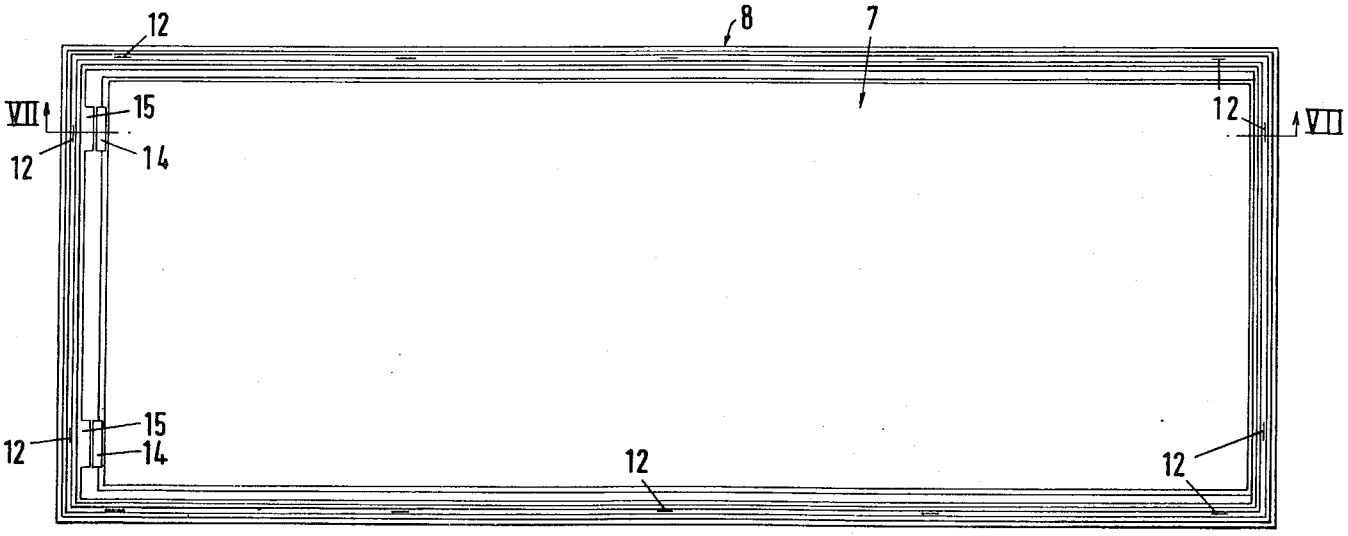
FIG. 8 is a section on line VIII—VIII of FIG. 7.

FIGS. 6 to 8 illustrate the preferred containerization arrangements; in this the end wall elements 9, 10 are packed between the floor panel 7 and ceiling tray 8 and the latter is fitted between the opposed wall trays 1, 2. The several elements have tongues and grooves as indicated at 11; these serve to locate the elements both in their containerization arrangement when assembled to form a room. Thus, the unused grooves **11*a* in FIG. 6 receive tongues of the ceiling tray in the assembled arrangement. The elements also have interlocking devices 12**, preferably "Rotalocks" (Trade Mark), which are readily locked together or released, for assembling and dismantling the container and assembling the room.

At the corners of the wall tray and therefore at the corners of the container are standard container lifting blocks 13 which serve both for handling the container and for interconnecting adjacent rooms and other elements of a structure. The external dimensions over the lifting blocks are 8 feet square.

The containerized arrangement of elements 8, 9, 10 is shown in FIGS. 7 and 8. It is not always possible to ensure that the various elements have such dimensions as to fit together snugly both when containerized and when assembled as a room. In particular the floor panel 7 may be somewhat shorter than the ceiling tray 8 as shown, and therefore I provide tongue and groove spacers 14 to hold the floor panel in place; mating tongue and groove elements 15 of the ceiling tray may be used as decorative elements in the assembled room.

Figure 9:
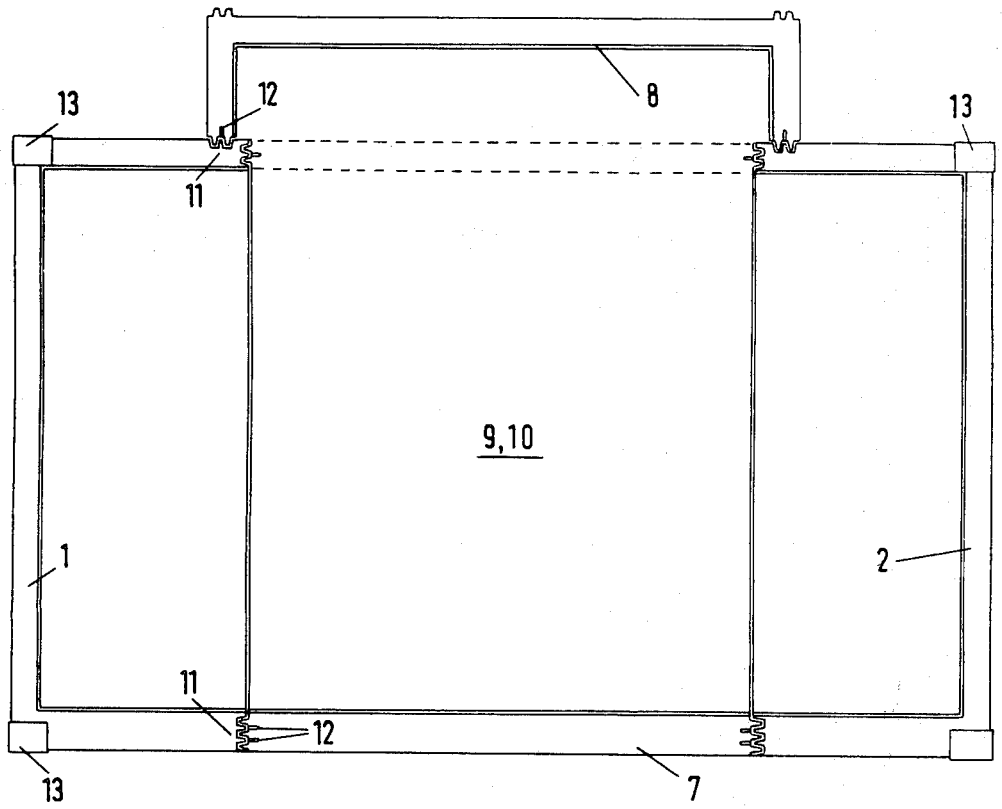
FIG. 9 is a cross-section of an assembled room unit.
Figure 10:
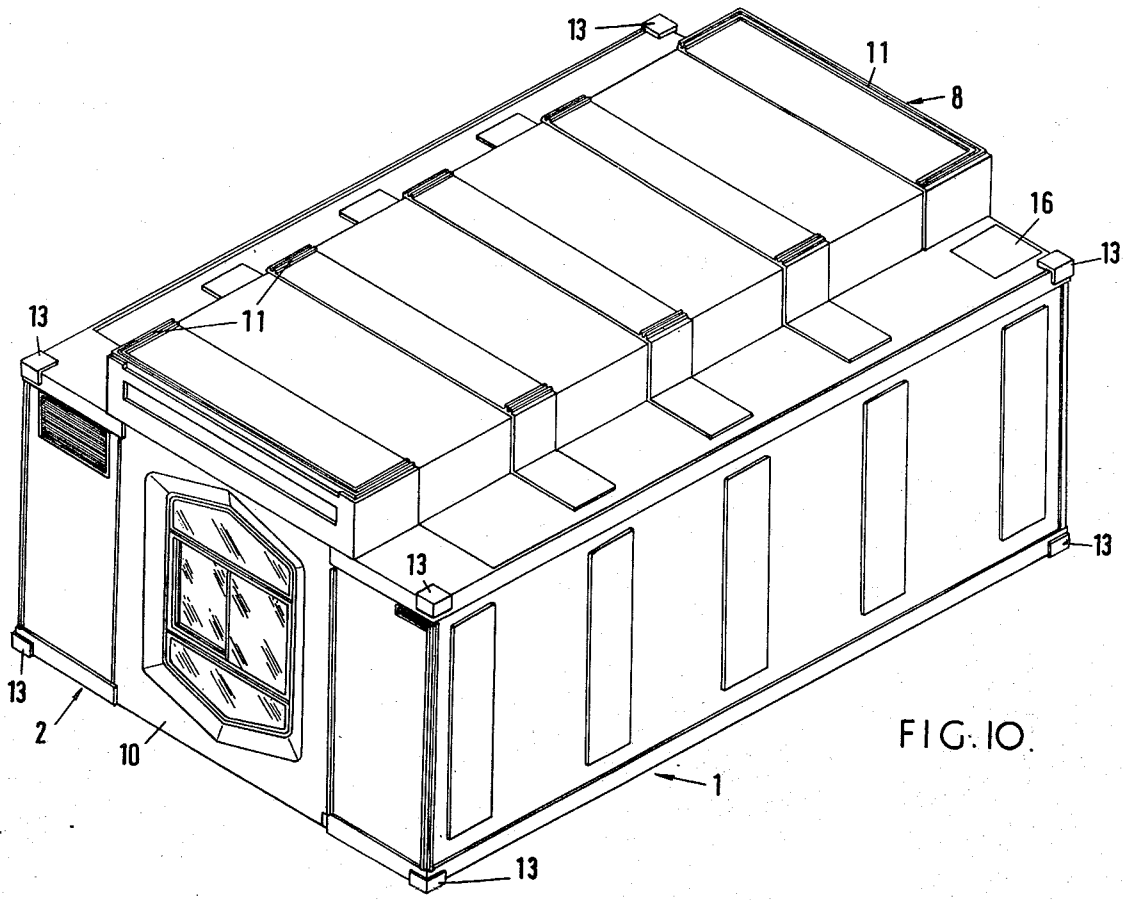
FIG. 10 is an isometric view of an assembled room unit.

The assembled room is shown in cross-section in FIG. 9 and in an isometric view in FIG. 10. The interlocking of the tongues and grooves can be seen in FIG. 9. The overall dimensions in cross-section are 13 feet 2 inches wide by 9 feet 7 inches high, representing an almost twofold increase in volume over the container. FIG. 10 shows, by way of example, one form of window panel 10. It also shows the side and top surfaces as consisting of alternate raised and recessed areas, differing in height by e.g. 1 inch. The recessed portions can serve as rain gutters; in the containerized arrangement they can also serve to house cladding panels which are detached at the site and used to clad the building and in particular to cover the gaps which will exist between adjacent assembled room units. Also visible in FIG. 10 is a cover 16 of a services duct, to be described below.

The elements of the room unit are constructed of glass fiber reinforced plastic on a structural steel framework or armature which is continuously interconnected throughout the assembled building and constitutes the principal load-bearing means. This framework is connected to the lifting blocks 13 which in turn are interconnected. The nature of the steel framework will be appreciated from FIGS. 11 and 12.

Figure 11:
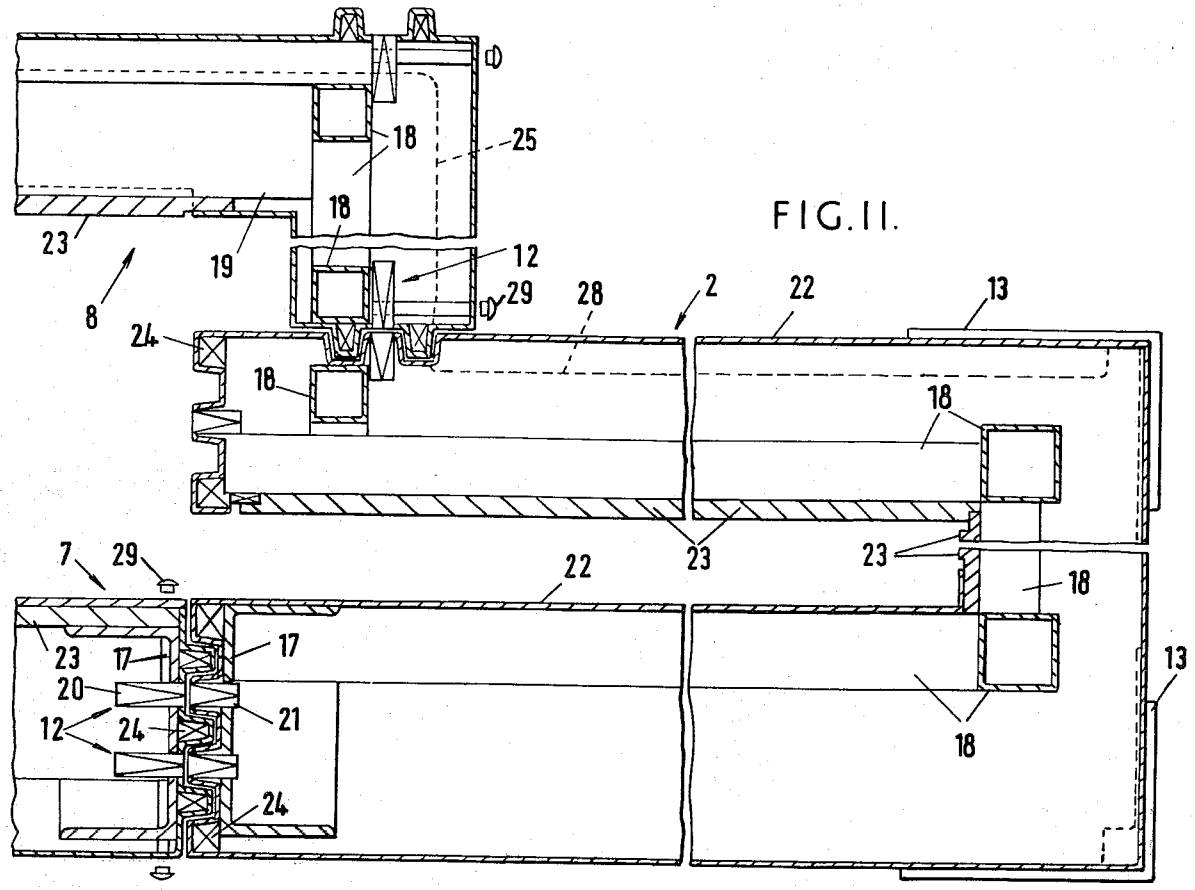
FIG. 11 is a cross-section of part of the assembled room unit on a much larger scale.

FIG. 11 is a cross-section through a wall tray 2 and adjacent parts of the ceiling tray 8 and floor panel 7. Along the mating edges of panel 7 and wall tray 2 are steel channels 17. The remainder of the framework comprises longitudinal, vertical and transverse square-section hollow steel sections 18 forming a continuous structure throughout the elements, and I-section transverse beams 19 in the roof tray. "Rotalocks" 12 are secured to the steel framework to interconnect the elements. Each of these locks consists of a male part 20 on one element and a female part 21 on the other element. The male part contains a rotatable half-disk which, when rotated, projects from the male part and enters the female part thereby locking the two parts together. The male part has a projecting key for rotating the disk and corresponding access holes or key extensions are provided for operating the locks embedded in the elements. Thus, loading is carried directly to the steel framework.

The framework is clad with a skin 22 of glass-reinforced plastic, and plywood or other cladding 23 for the floor, internal walls and ceiling. Reinforcement e.g. hardwood blocks 24 may be provided inside the tongues by which the elements are located together. FIG. 11 also shows in dotted lines outline 25 of the recessed parts of the external top and side surfaces.

Figure 12:
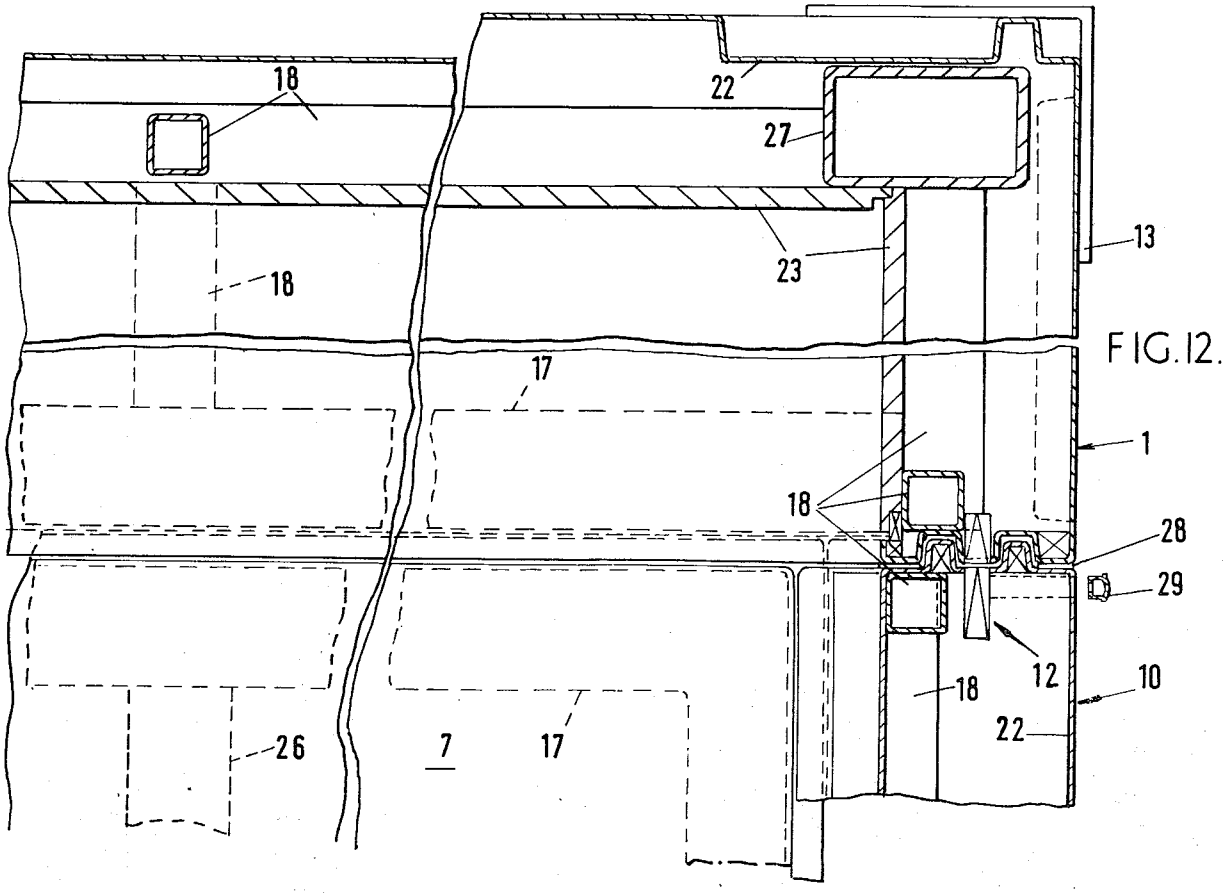
FIG. 12 is a plan section of part of the assembled room unit.

FIG. 12 shows more of the framework. The floor panel 7 has channels 17 around its edges and a transverse rolled steel joist or joists 26. At the vertical corners of the wall trays are large hollow steel sections 27 (e.g. 5 inches × 3 inches), interconnected by the narrower hollow sections 18 and connected to the lifting blocks 13.

Between adjacent elements flexible inserts 28, e.g. of "Neoprene" (Trade Mark), may be placed to provide a weatherseal. Caps 29 cover the access points for the "Rotalock" keys.

To form a multi-story building, room units can be stacked one on another up to a limit imposed by the strength of the steel framework, e.g. about seven or eight stories. To transmit load directly between the steel frameworks, the lifting blocks 15 are interconnected so that the room units themselves are spaced apart and receive no load from adjacent units except through the lifting blocks. This arrangement is earthquake-resistant. The connector may be a simple metal upright with projecting studs at top and bottom to engage the eyes of the lifting blocks; or it may be a double upright for supporting two adjacent room units, with an appropriate number of studs; it may have one or more cantilever arms projecting at top and/or bottom for supporting portions of the building adjacent to the room unit or units; instead of studs it may have locking projections which can enter and be locked in the eyes of the lifting blocks, e.g. twist-locks of the kind used for handling international standard containers.

Figure 13:
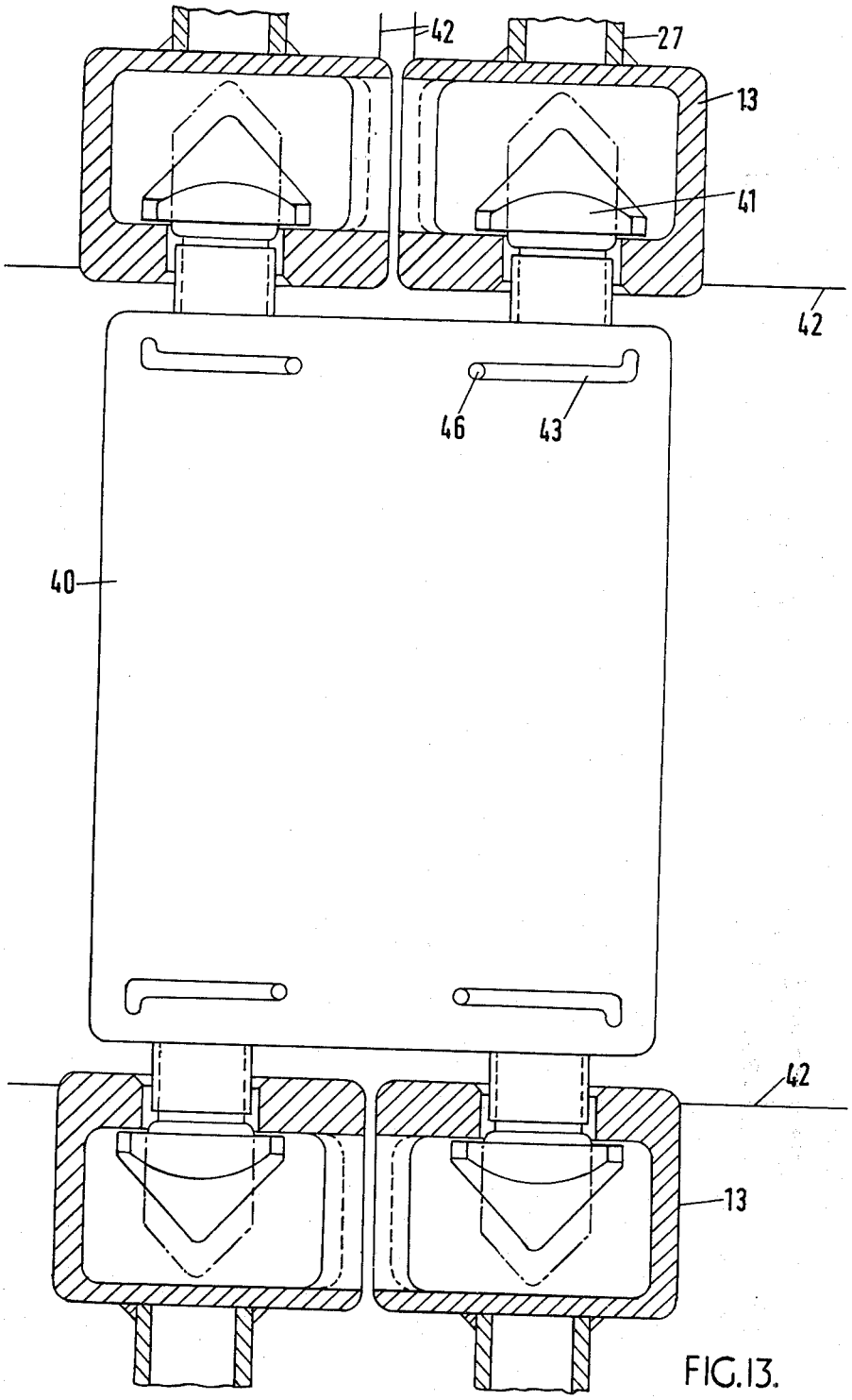
FIG. 13 shows a locking device for interconnecting the room units.

FIG. 13 shows a double two-prong locking device having a housing 40 provided on opposite sides with pairs of twist locks 41 each comprising a projection adapted to enter and when twisted be retained in a lifting block or eye 13 provided on a container or component. In the case of a container or room unit, the edge of the container would be as indicated by lines 42. The cam slots for operation of the twist members 41 are shown at 43; each member is turned by a handle 46 in slot 43, with the shape of the slot being such that when the handle is moved to lock the projection in the eye, the handle and projection are also moved to pull the projection towards the housing 40 to clamp the eye. It will be seen that there is a gap between units one above another and consequently the weight is transmitted entirely through the blocks 13 and locking devices. The reinforcing members 27 in the units, transmit the vertical loads, so that the walls of the units are not themselves subjected to stress arising from the weight of overlying units. I may also provide a foundation locking device, consisting of two twist locks on a jack by which the structure can be levelled, and a locking device for securing together units at the top of a structure. It will be realized that any desired number of locks could be provided at the top and/or bottom, e.g. four locks for connecting together four adjacent units.

Each twist lock projection may have a screwed shank joined in vertical pairs by a turnbuckle by rotation of which the projections of the pair can be drawn towards the housing 40 to clamp the associated eyes. Alternatively, webs of the housing contain sockets for receiving reinforcing stanchions e.g. of steel, or through passages for steel tie rods to enable taller buildings, e.g. seven stories, to be erected. The number and disposition of the sockets is obviously open to variation according to the needs of any particular structure. The locking devices may have through passages for services, drainage, etc.

By using such readily detachable locking devices for interconnecting the units and other components, e.g. corridor floor and ceiling panels, the units, and structures incorporating units, can be made readily collapsible so that they can be transported to another site. This feature is particularly valuable if the units are to be used, for example, to construct a field hospital. It is also envisaged that the units may be used to construct holiday chalets.

Alternatively, the locking projections may be replaced by simple studs, the building being tied together by vertical tie rods extending through the vertical reinforcements 17 and the vertical interconnecting members.

Figure 14:
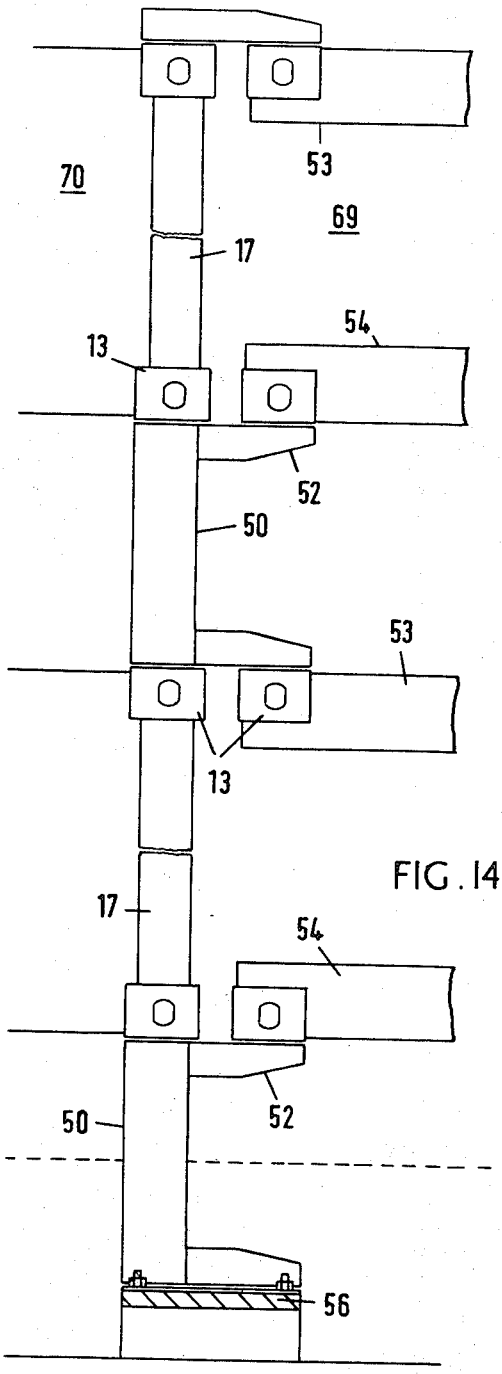
Figure 15:
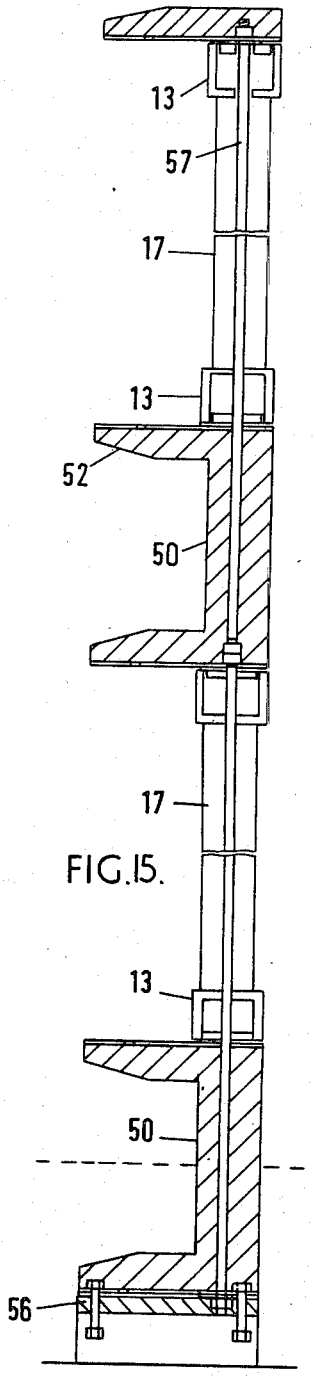
Figure 16:
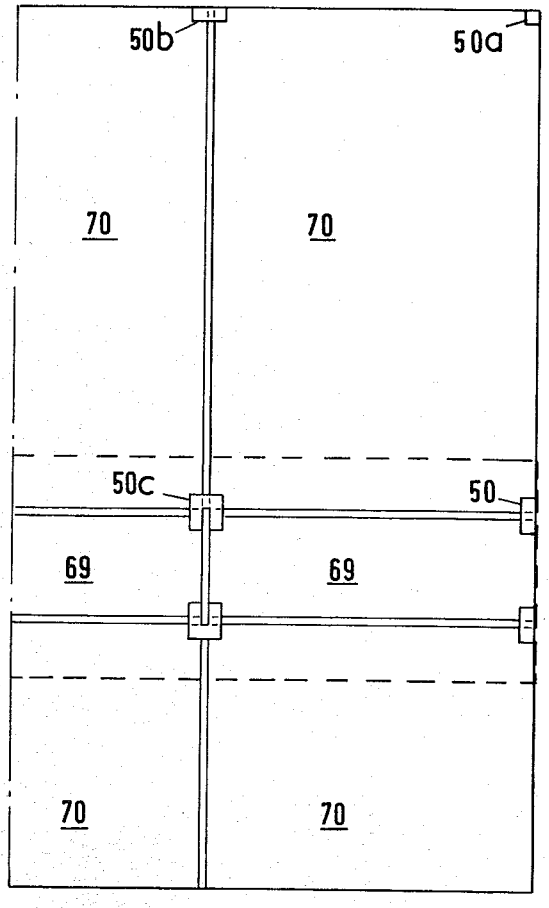

FIGS. 14 to 16 of the accompanying drawings show steel junction units 50 comprising upright portions with studs 51 at top and bottom and cantilever brackets 52 welded to the top and bottom.

Assembled room units and intervening corridor floor and ceiling panels 54, 53 are stacked one above another, separated by junction units. The corridor ceilings 53 and floors 54 and the steel upright frame members 17 are provided with standard container lifting blocks 13 into which fit the studs 51. The entire assembly is interconnected by post-tensioned tie rods 57 which extend through the frame uprights 17 and the uprights of the junction units, as shown in FIG. 15. The lowest room and corridor units are supported by a junction unit on the foundations 56. This arrangement is suitable for up to eight stories.

FIG. 16 shows a typical layout of room units 70 and corridor units 69. At the corners of the building are single junction units 50*a* which do not have the brackets 62. Where two rooms adjoin, there is a double junction unit 60*b* which interconnects the rooms. Where a corridor adjoins one or more rooms, there are single or double junction units with two or four brackets to support the corridors; the junction units with four brackets, in plan, have the shape of a U, as shown in FIG. 16 at 50*c*. The corridor floor and ceiling panels are secured to the brackets by locating lugs and high-tensile bolts.

In another possible arrangement, the corridors are formed by pairs of panels cantilevered from opposed room units and of a length corresponding to the door and floor panels, with which they are aligned; the gaps remaining between these pairs of panels are bridged by further panels secure to the panels of the pairs e.g. by "Rotalocks." The panels of the pairs extend below and above the door panels, which rest on the corridor floor panels.

A further aspect of the invention resides in a prefabricated foundation/services unit; this comprises a shallow channel section member comprising support elements for the building in question, and incorporating prefabricated conduits and junction units for services. The foundation units are of rectangular cross-section and of such dimensions as to form an assembly of standard container dimensions when stacked together, preferably in fours. Preferably, the ends of each unit are closed so that the container assembly is closed and can be used for transportation of loose foundation elements.

Figure 17:
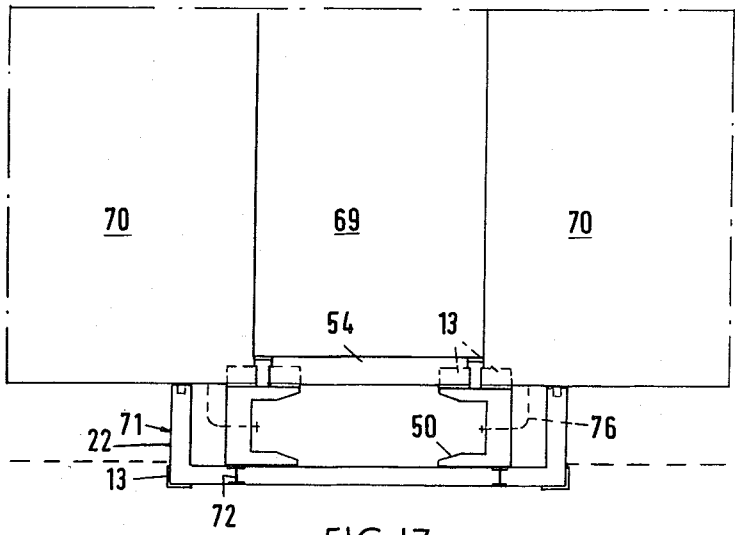
FIGS. 17 and 18 show a prefabricated foundation unit.
Figure 18:
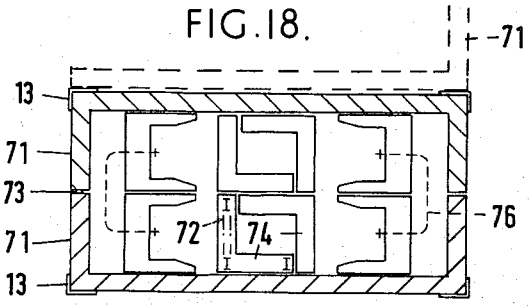

One convenient form of foundation/services unit 71 is illustrated in FIGS. 17 and 18 of the accompanying drawings.

The unit 71 is a shallow rectangular box open at the top and made, for example, of glass-fiber-reinforced resin incorporating steel work as indicated at 72. At the corners are container lifting blocks 13. The unit is of international standard container width and length and a quarter of standard container height. The sides are provided with locking means at 73 so that a pair of units can be secured together face to face to form a container, and two such pairs can be stacked together to form an assembly of standard container dimensions. The closed containers thus formed can be used for transportation of, for example, elongated L-section foundation units 74.

The foundation units illustrated are designed specifically for use with the corridor and room units of my factory building system, in which the corridor width is half that of an international standard container and accordingly half that of the foundation unit. The outline of a foundation unit is shown in dotted lines in FIG. 16. To support the room and corridor units, the foundation unit 71 contains fixed junction units 50 or 50*c* for supporting the rooms, with brackets for supporting the corridor floor 54. It will be seen that the foundation unit forms a void underneath the corridor and the edges of the adjacent rooms. Within this void, that is within the foundation unit and prefabricated therewith, are services connections and conduits as indicated in dotted lines at 76 in FIG. 17 and FIG. 18. The services are connected to the room fittings at the ends of the rooms; it will be understood that plumbing, electric fittings and the like are prefabricated into the rooms at the factory, and accordingly the only work necessary at the site is to make the connections between the rooms and the foundation unit, and between the latter and the mains.

The foundation elements 74 are placed along the edges of the building parallel to the units 71 and are of substantially the same length. They may also be made of glass-reinforced resin with metal framing. Normally, the foundation units 71 will be laid first, then elements 74 will be laid parallel, and finally the room units 70 and corridor units 69 will be placed on the foundation thus formed. Elaborate site preparation is not needed, it is only necessary to provide a firm level surface for the prefabricated foundation members.

It will be recalled that the international standard container dimensions are a square cross-section of side eight feet, the standard lengths being 10 feet, with 20 feet and 40 feet. I prefer to make the foundations in 40 foot lengths, the room units, when assembled, being of a width of 13 feet 2 inches, so that three rooms correspond to a single foundation length. Of course, it is not necessary that the rooms be provided in multiples of three.

The foundation unit illustrated is primarily suitable for buildings up to three or four stories high, but is also suitable for single story buildings and under platforms.

It will be seen that there is a crawling space between the two lines of services along the sides of the unit. The services may, for example, incorporate drainage, mains water, rain water, electricity and telephones. Lighting sockets may be provided at intervals corresponding to the associated room units, for inspection, and rails and a trolley may be provided in the unit to facilitate maintenance. Access hatches may be provided at the ends of the units.

Figure 19:
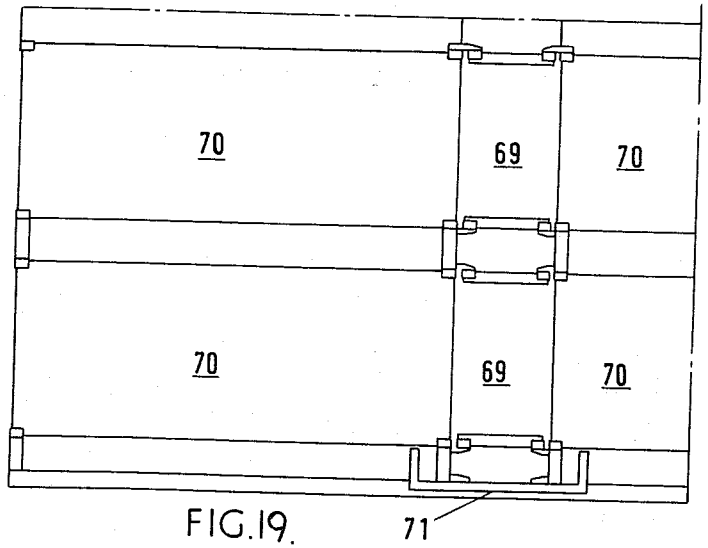
FIG. 19 shows an assembly of room units, corridors and foundation units forming part of a building.

By way of further illustration, FIG. 19 shows an assembly of rooms, corridors, junction and support units, and foundation services.

According to a further aspect of the present invention, interconnecting portions of services for adjacent room units or other adjacent units can be withdrawn into a containerized unit for transportation in container form and can be projected from the unit at the site for connection to an adjacent unit or services. In one convenient arrangement, a services junction unit incorporates pipes, conduits and the like as necessary and has a first position in which the pipes, conduits and the like register with fixed pipes, conduits and the like in the associated room or other unit; in this position, the services junction unit projects so as to register with the services connections of an adjacent room unit. The services junction unit and the fixed services in the associated room or other unit are so disposed that, by rotating the services junction through a certain angle, it can be withdrawn into the associated unit.

Figure 20:
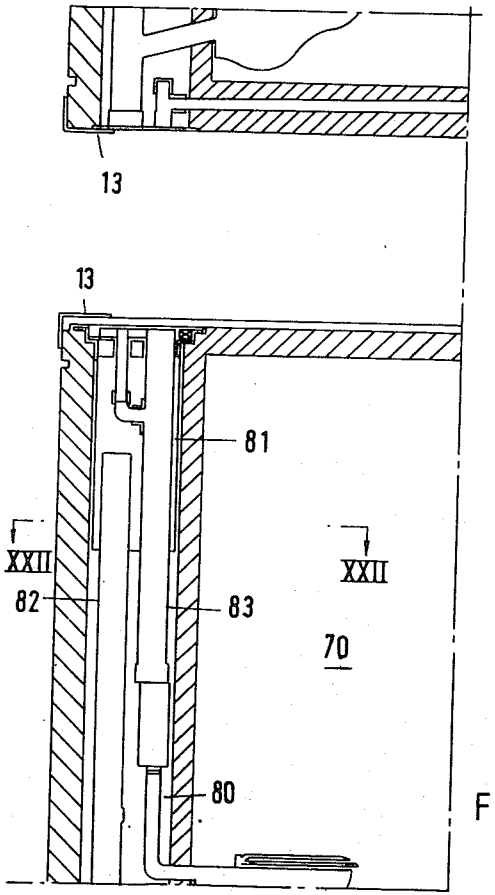
FIGS. 20 to 22 show means for interconnecting service ducts of stacked room units.
Figure 22:
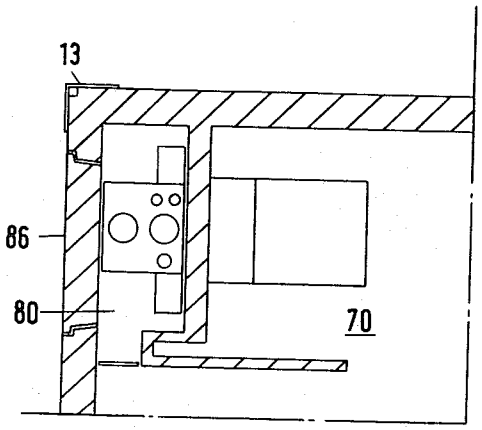
Figure 21:
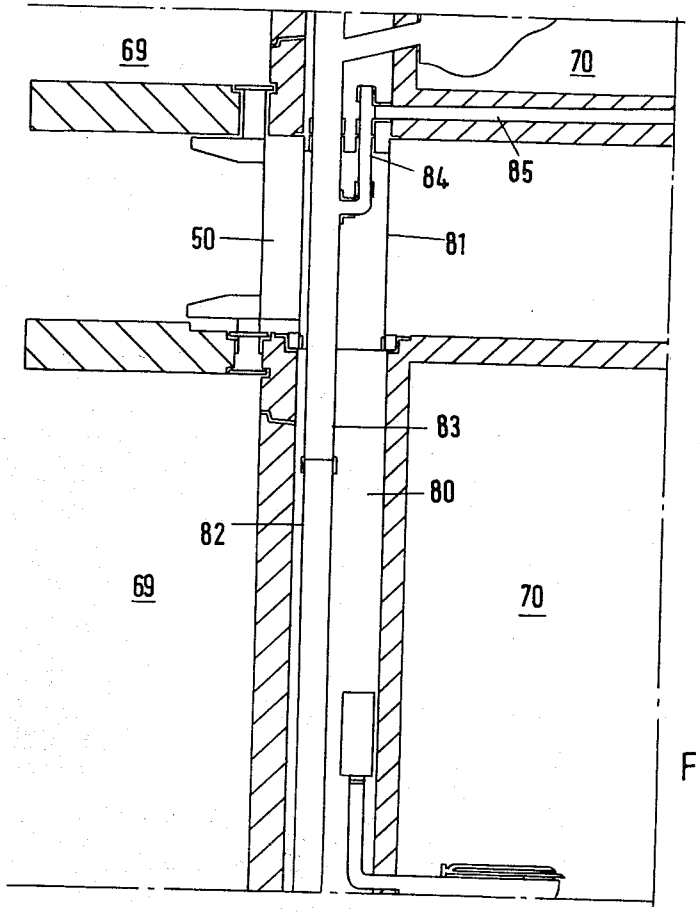

One convenient form of services junction is illustrated in FIGS. 20 to 22. In my preferred design of room unit, one wall tray of open box-like construction contains all sanitary and related services. Vertically along one corner of such a tray (or equivalent portion of a room unit of other design) is a permanent duct 80 containing fixed services, for example electricity, water, and drain pipes. Conveniently, this duct is placed behind the water closet, and has an external access hatch 86 and a top cover panel during transport or when at the top of a building.

At the top of this duct is a services junction unit 81 of glass-reinforced resin, incorporating pipes, conduits and the like corresponding to the fixed services in the duct. The drain pipe 82 is illustrated in FIGS. 20 and 21 and the junction unit 81 incorporates a length of drain pipe 83 corresponding to the fixed drain pipe 82. For transportation, the services junction unit 81 is rotated through 180° so that the pipe 83 does not register with the fixed pipe 82 and can lie alongside it, so that the unit 81 can be withdrawn into the container for transportation as shown in FIG. 20. On the site, as shown in FIG. 21, the junction unit 81 is lifted out of the duct 80 and rotated so that the pipes and conduits register with the fixed ones in the duct 80 of the associated room and of the room immediately above. Thus, in FIG. 21 it will be seen that a branch connection 84 of the drain pipe registers with the waste pipe 85 of the upper room unit 70. The pipes, conduits and the like are provided with telescopic junctions to prevent them from being stressed by the weight of the upper room unit, should there by any mis-alignment.

The room units described hitherto have been assembled from a single container and employ single longitudinal floor and ceiling elements. However, larger rooms may be assembled by means of a plurality of transverse floor and/or ceiling elements.

The unit dimensions preferably conform to international container standards. It is, however, to be understood that the present invention in its broadest aspect is not confined to units having dimensions conforming to these standards.

The embodiment shown in FIGS. 23 to 31 of the drawings is for a single-bedroom chalet or hotel suite.

The unit has two side wall trays, each substantially rectangular and consisting of the wall proper, portions of the adjacent floor and ceiling, and portions of adjacent end walls. One of these wall trays, identified by reference 2, has built in cupboards as indicated at 3 and divans as indicated at 6. It is to be emphasized that the nature and arrangement of these fittings are open to the wide variation.

Figure 27:
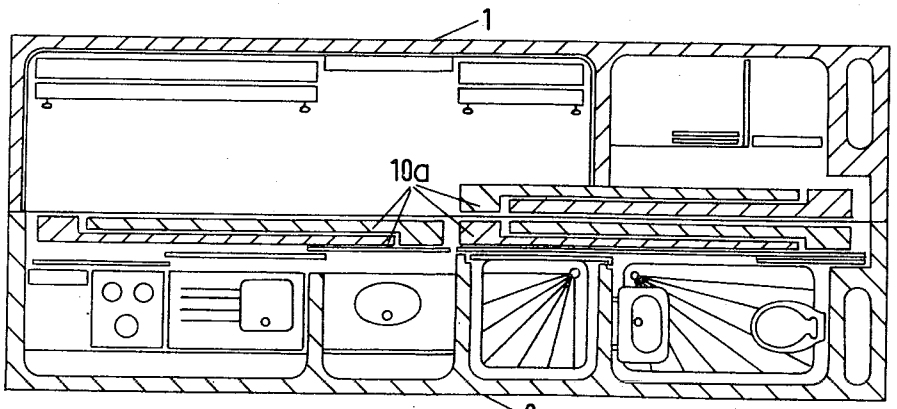
FIGS. 27 to 31 show the unit collapsed to form containers for transport.
Figure 28:
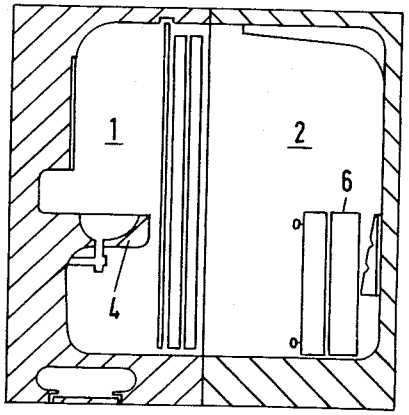

The opposite wall tray, reference 1, contains sanitary equipment as indicated at 4, and kitchen equipment at 5. These two wall trays can be placed together as shown in FIGS. 27 and 28 to form a rectangular container accommodating the fittings in question.

The floor of the unit consists of three strip-like floor panels 7*a* extending transversely between the side wall trays. Conveniently, to provide rigidity, the floor panels have flanges 90 along one or both edges as shown in FIG. 24.

Figures 24, 25:
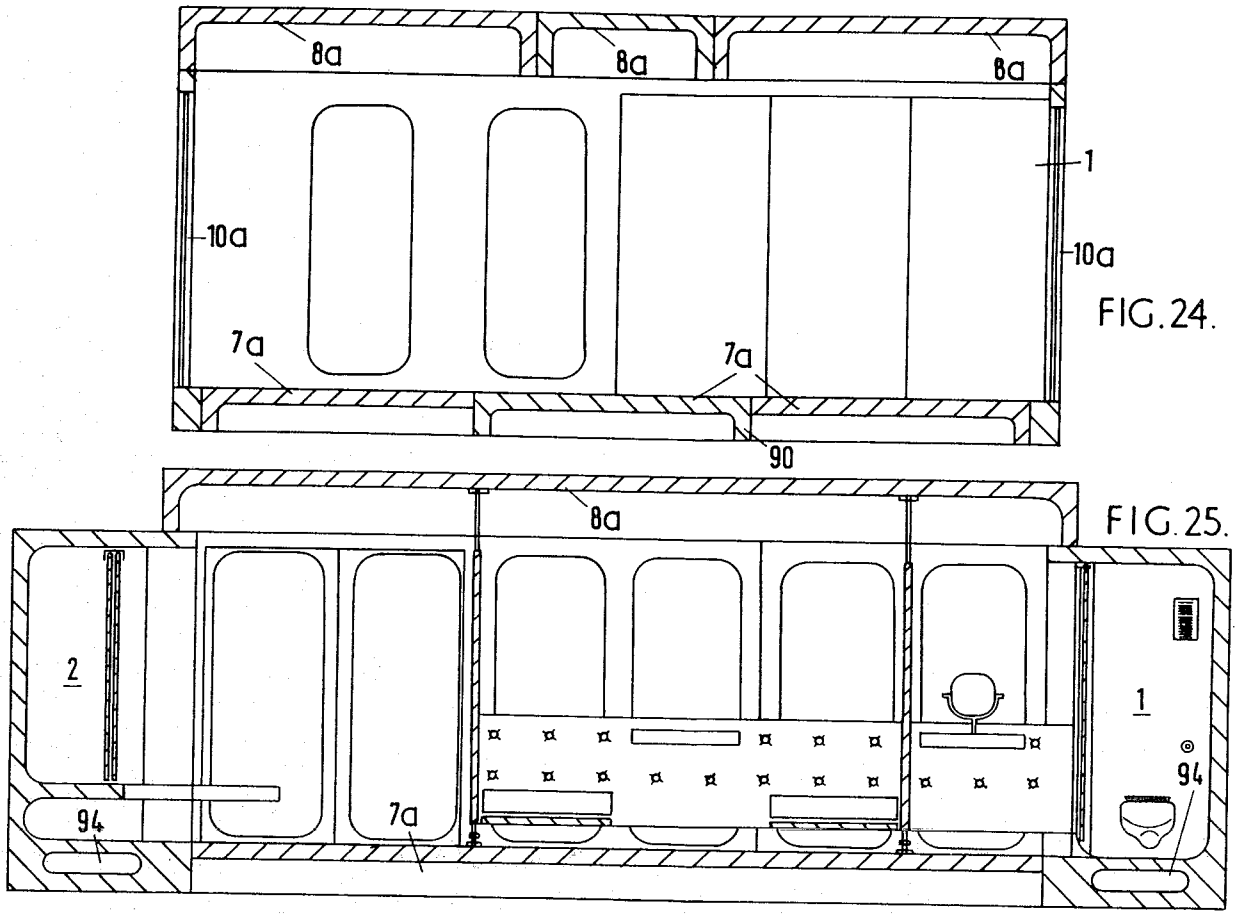
FIG. 24 is a transverse cross-section on line XXIV—XXIV of FIG. 23.
FIG. 25 is a longitudinal section on line XXV—XXV of FIG. 23.
Figure 26:
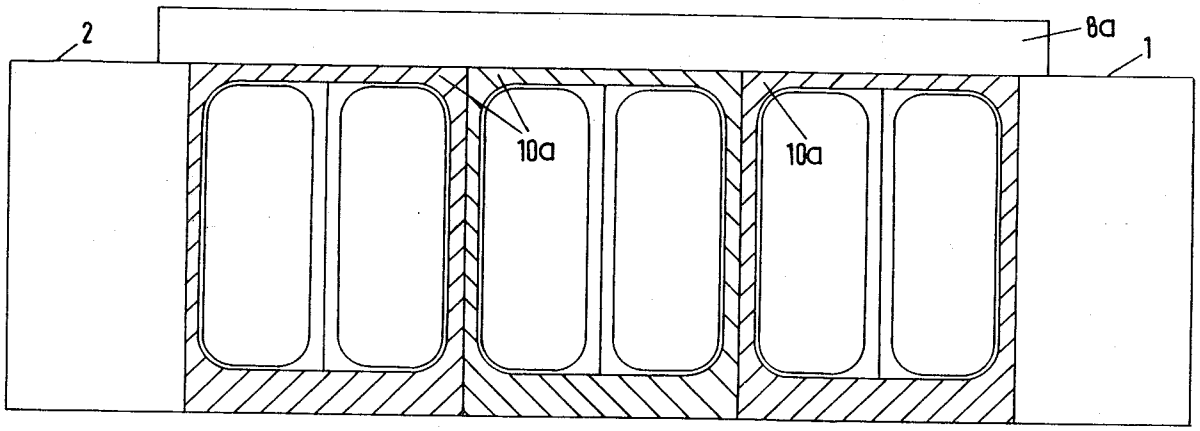
FIG. 26 is a side elevation of the assembled unit.

The ceiling of the unit consists of three ceiling trays 8*a* which bridge the ceiling portions of the side wall trays, as shown in FIG. 25.

The unit is completed by two window or door walls each consisting of three panels 10*a* which may incorporate windows or doors.

The various components of the unit may be made of any convenient material, for example fiber-reinforced plastic, or lightweight concrete.

Figure 31:
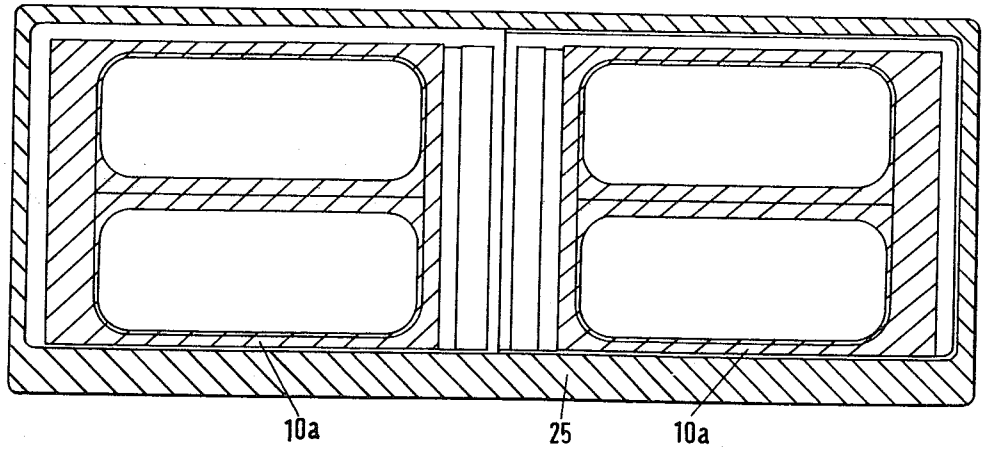
Figure 32:
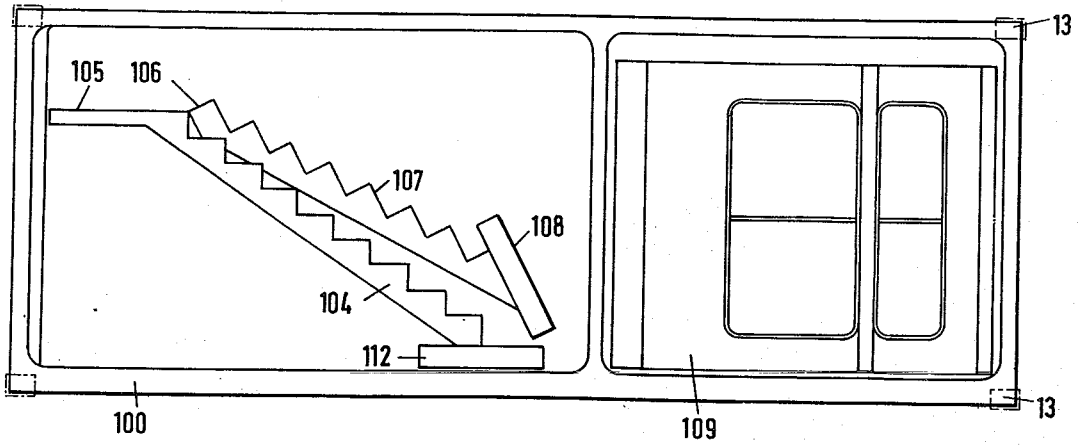
FIG. 32 is a side elevation of a staircase, in section on line XXXII—XXXII of FIG. 34.

The unit is transported from the factory to the erection site, or from one site to another, in the form of rectangular containers. One such container consists of the wall trays 1 and 2 together with the inbuilt fittings, as shown in FIGS. 27 and 28. The panels 10*a* are also packed inside this container for transportation, as shown in FIGS. 27 and 31.

Figure 30:
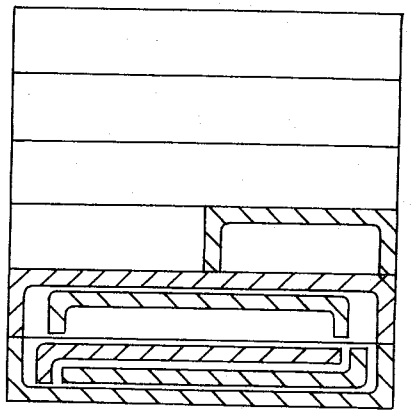
Figure 29:
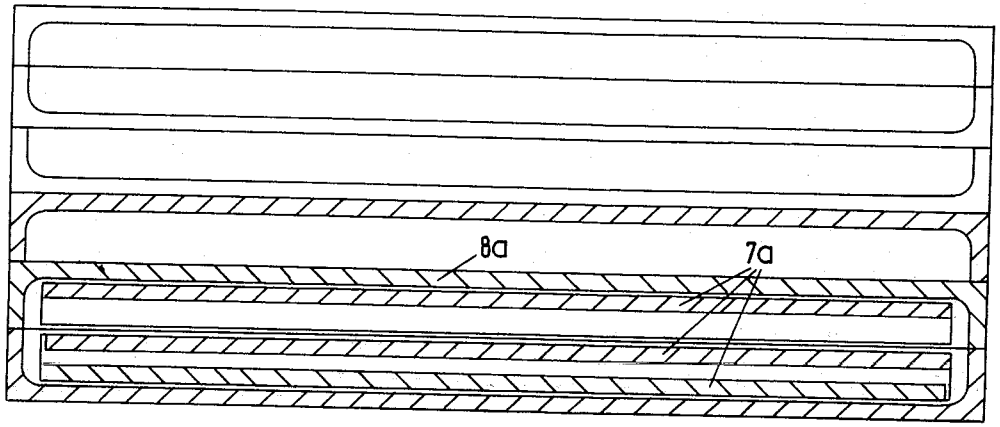

The ceiling and floor elements are packed together as shown in FIGS. 29 and 30, with the floor strips being nested inside a shallow rectangular container formed by the two larger ceiling trays. To form an assembly of overall dimensions corresponding to a standard container, several trays may be stacked together as indicated in FIGS. 29 and 30. The central ceiling tray is half the width of the two outer ceiling trays so that two of the central trays can be stacked side by side, as shown in FIG. 30.

Figure 23:
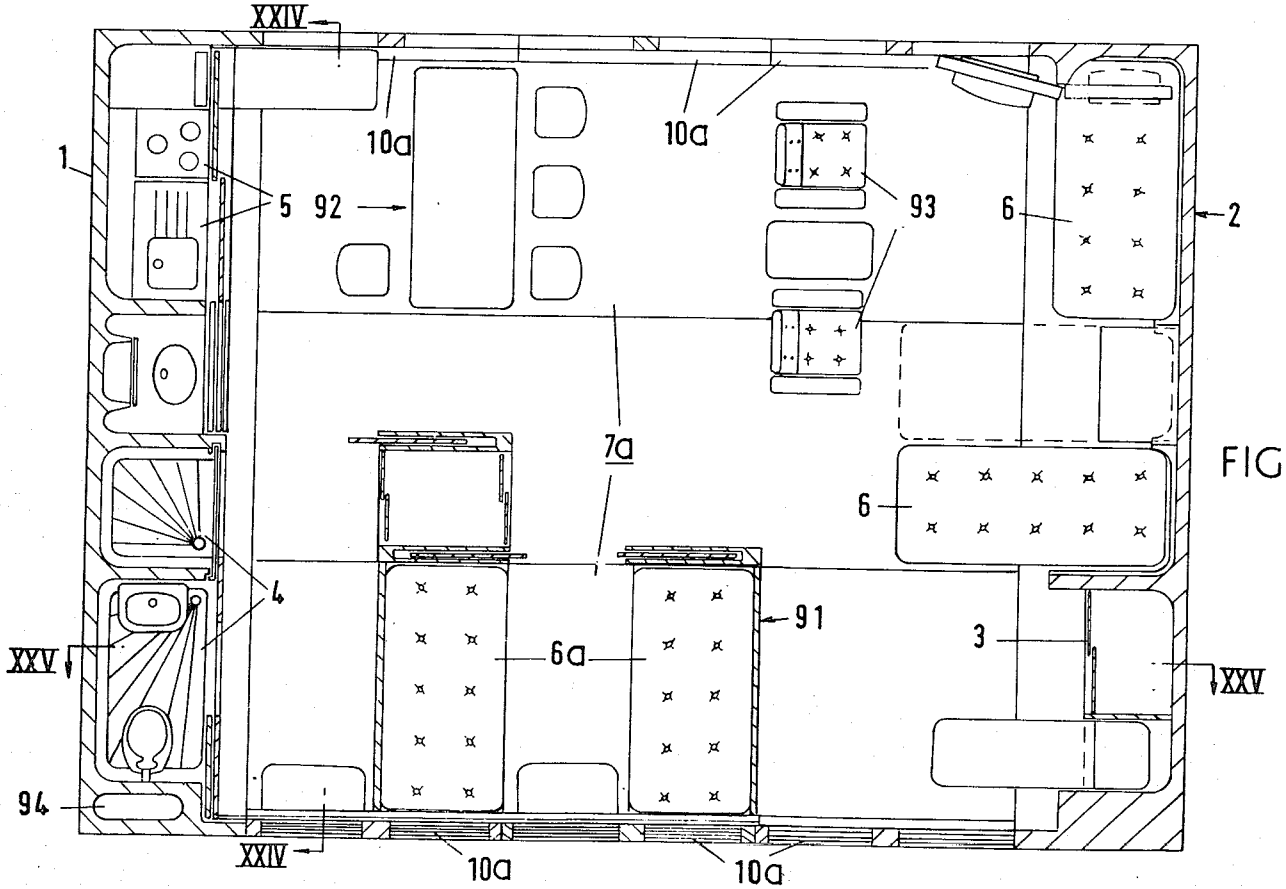
FIG. 23 is a plan, in section of an assembled room unit according to a further embodiment of the invention.

The major container formed by the wall trays 1 and 2 can also be used to transport loose items of furniture and other equipment in addition to the inbuilt fittings. For example, the unit shown in FIG. 23 is furnished with further divans 6*a* inside a partition 91 which may also incorporate further cupboards, and the unit also has a dining table and chairs at 92 and armchairs at 93. It will be understood that the furnishings shown in the drawings are given by way of example only. The unit shown may form a self-contained chalet, or part of a hotel. However, the same basic unit structure may equally well be used, for example in a field hospital, being provided, for example, with surgical equipment.

In an alternative arrangement, one of the ceiling elements, conveniently the middle one, is in the form of a panel instead of an inverted tray. This ceiling panel bridges the wall trays and is flush with their tops; it is, for example, provided with tongues and grooves to locate its ends in the upper edges of the wall trays which are provided with corresponding tongues and grooves. The rest of the ceiling is formed by two inverted trays, preferably one or each side of the ceiling panel with their sides resting on the sides of the ceiling panel and their ends resting on the wall trays. The main advantage of this arrangement is that in the containerized form all of the wall panels and floor panels and the ceiling panel can be packed inside a container formed by the two ceiling trays; it is not necessary to pack the wall panels in the main container formed by the wall trays. The ceiling panel will be wider than the half-width central ceiling tray of FIGS. 23 to 31, since it extends underneath the sides of the other ceiling trays instead of merely filling the gap between them.

Although the unit described has three floor panels and three ceiling trays, similar units may be provided with two floor panels and ceiling trays, or any greater number, for use with wall trays of greater length. For example, a unit having wall trays twice the length of those shown in FIG. 23 may conveniently have five ceiling trays of equal width. Similarly, the number of panels 10*a* and the length of the floor panels and ceiling trays may be selected to provide desired dimensions of the completed unit.

Various parts of the structural components of the unit may incorporate ducts for services, for example electricity supply and plumbing, as indicated at 94 in FIGS. 23 and 25. The flanged floor panels illustrated are designed to provide a flush floor in a unit provided with such ducts in its floor. If the ducts are not provided, the floor panels can be made completely flat.

The unit described and shown in FIGS. 23 to 31 is of such dimensions that the two wall trays together form a container of square cross-section and the floor and ceiling components, stacked, if necessary, together with similar components of a further unit, constitute a second container or stack of square cross-section. It is, however, possible that the wall trays may be of sufficient depth to form when placed face to face a container of square cross-section, with the square cross-section being made up by a ceiling tray (or other component) stacked together with the wall trays. For example, a ceiling tray whose width is equal to the height of the wall trays, and which may accommodate a floor panel, may be stacked between the two wall trays or against the outer face of one of the wall trays. The wall trays need not be of equal depth. It is to be understood that this method of stacking wall trays with other components to make up a square (or any other desired) cross-section is also applicable to the smaller units previously described.

According to a further aspect of the invention, elements of a building, other than room units, may also be prefabricated for transportion collapsed in container form, so that an entire building can be prefabricated and transported to its site, or from one site to another, in container form. For example, a staircase hinged at an intermediate point may be housed in a container in a folded state, having when unfolded a height substantially greater than that of the container. The staircase may for example be hinged about an intermediate point, for example at an intermediate landing. In one convenient arrangement, such a staircase is housed in a container comprising two side wall trays, a lower flight of stairs being secured to a floor panel and extending up to an intermediate landing at which is hinged an upper flight. When the container is opened, the floor panel is placed between the two side wall trays and the upper flight is lifted so as to extend above the side wall trays. The two side wall trays may constitute a stairwell and may have apertures to permit free passage up and down the staircase. The container may further incorporate a ceiling tray, packed for example, between the wall trays, and provided with an aperture through which the erected staircase can pass.

One convenient arrangement of such a staircase is shown by way of example only in FIGS. 32 to 35 of the accompanying drawings.

In all of these figures the staircase unit is shown in its container form.

The unit shown also incorporates a hallway.

The unit has side wall trays 100 and 101 and a ceiling tray 102 with an aperture 103 therein. The wall trays and the ceiling tray between them together form a container of square cross-section, containing a floor panel on which is mounted a lower flight 104 of a staircase, leading up to an intermediate landing 105. A continuous hinge at 106 on a top flight of stairs 107 secures the latter to the intermediate landing. The top flight leads to a top landing 108 integral with the top flight. As is seen best in FIG. 32, the top flight is folded down about the hinge 106 so as to be accommodated within the container. When the wall trays 100 and 101 are separated and the ceiling tray 102 removed, a floor panel, indicated at 112, is placed between the wall trays and the upper flight 107 is lifted about its hinge so that it extends above the wall trays. The ceiling tray 103 bridges the wall trays and the upper flight extends through the aperture 103, so that the top landing 108 can be secured to an upper unit or other portion of a building.

The unit also includes a portion constituting a hallway or lobby at 109. This portion, when in container form, contains floor and window trays and panels 110 as required to complete the unit when erected. This portion may also contain other equipment and fittings, for example drink-vending machines 111.

A handrail may be placed between the flights on a continuous narrow column, being folded by means of hinges for transportation. In the erected condition, the column and balustrade are bolted to both flights.

It may be desirable or necessary, when a plurality of rooms are grouped together whether horizontally or vertically, to provide a corridor as already described or verandah. For this purpose, I may provide corridor panels of dimensions corresponding to the components of the units so that they can be transported in a common format and attached to the units in any convenient manner, e.g. by the lifting blocks.

Other components and units that may be provided in containerizable form include, for example, elevators and elevator shafts, and corridor and/or balcony or verandah floor and/ or ceiling panels as already mentioned. It is a consequence of international container standards that when such containerizable panels are erected there will be a gap all around which must be covered. This gap is conveniently used to accommodate drainage and other services. To cover the gap in the erected structure, I may provide a cover strip which forms a flap during transportation, being e.g. hinged to the panel edge. The cover strip is, conveniently, provided with the necessary connections or unions for attachment of services for individual rooms or locations.

In one convenient arrangement, I provide an elevator assembly comprising at least two transportable containers, preferably also of international standard container dimensions, one container comprising elements to constitute an elevator well and an overhead machine room, and at least one further container comprising elements for constituting an elevator shaft and serving for transportation of at least one elevator car.

Preferably there are two elevator cars with respective shafts. During transportation, the container which is to constitute the twin shafts contains the two cars placed end to end and also contains shaft wall elements; the container itself constitutes the outer side walls of the shafts and adjacent front and rear wall portions, with the shafts being completed by the wall elements transported in the container. This enables twin shafts, of dimensions exceeding standard international container dimensions, to be formed from a container of standard dimensions. In such a case, the well and machine room will also be transported as a standard sized container but expanded on assembly by incorporation of further wall elements, to correspond to the twin shafts.

Figure 37:
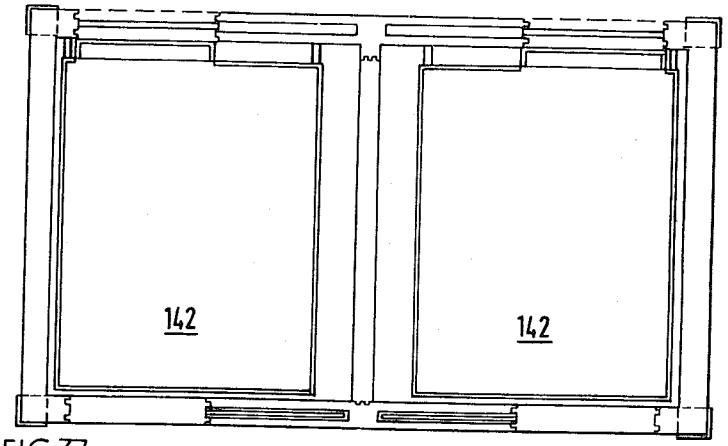
FIGS. 36 to 38 show a lift unit respectively in vertical and horizontal section and in containerized form.
Figure 38:
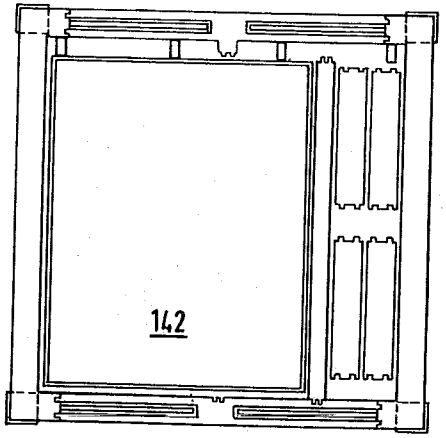

This aspect of the present invention is illustrated by FIGS. 37 and 38 of the accompanying drawings, which respectively show a vertical section of a completed elevator assembly, a cross-section through the elevator wells, and a corresponding cross-section of the well elements in a transportable container arrangement.

Figure 36:
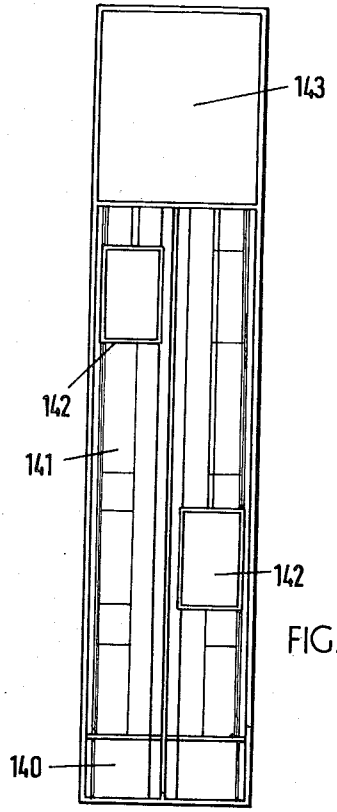

FIG. 36 shows an elevator assembly having twin wells 140 and shafte 141 in which run elevator cars 142 driven from the machine room 143 above the shafts. The elevator cars themselves and associated hoist and control gear can be of any convenient kind. The well height corresponds to international standard container lengths and the dimension from front to rear is the international standard 8 feet. The total height of the wells and machine rooms is the international standard container length, 20 feet.

The total width is, however, greater than standard container dimensions. To permit transportation as a standard container, the well, shaft and machine room units are collapsible as shown in FIGS. 37 and 38. Specifically, the side walls and portions of the front and rear walls together form a container of standard dimensions, as shown in FIG. 38. The remainder of the front and rear walls, and the partition between the two shafts and the two wells, are formed by detachable elements *a*, *b*, and *c* which are transported inside the containers constituted by the side wall elements *d*, front wall portion *e* and rear wall portion *f*. The elevator cars are transported, end to end, inside the container formed by the wall elements.

The elements *e* and *f*, as can be seen particularly in FIG. 37, also serve to house sliding doors *g*. In the arrangement illustrated, the elements *c* are solid while the elements *b* form doorways.

The various elements may be constructed of any convenient material, but I have found that glass fiber-reinforced resin on a steel load-bearing frame is particularly suitable.

Elevator runners are permanently fixed in position and the cars are cantilevered from the runners.

Preferably the elements are made with tongue and groove or mortise and tenon or other joining means so that they can be readily fitted together both for transportation and for assembly at the site. Standard container lifting blocks serve for connection to adjacent parts of the building.

It will be understood that single or multiple shaft elevator assemblies can be made transportable as container units in a similar fashion. In particular, in the case of the single shaft, the shaft itself can be made of standard container dimensions and does not have to be collapsible; the associated well and machine room similarly can be made so that together they form a container of standard dimensions, again without having to be collapsible.

My structural containers can also be used to house heavy plants and equipment, e.g. operating theatre equipment, for a field hospital, electrical sub stations or generators and airconditioning equipment. In such use, the arrangement of the elements when containerized will, in general, be different from that described above.

In particular, I have found it convenient to mount the plant or equipment in question on the floor panel, which is transported, with the plant or equipment thereon, inside a container formed by the wall trays.

Figure 39:
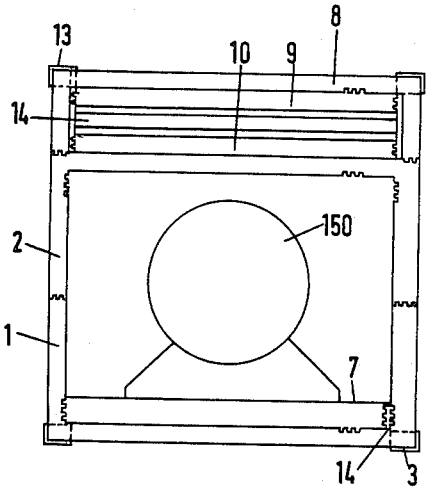
FIG. 39 is a cross section of containerized plant or equipment.

One convenient arrangement is shown in containerized form, in cross-section in FIG. 39. The plant e.g. a generator 150, is mounted on a floor panel 7 packed inside one of the wall trays 1, 2; the two wall trays, each 8 feet by 3 feet ⅛ inch, form a rectangular container which is made up to international standard container dimensions by the ceiling tray 8, window panel 9 and door panel 10. Spaces 14 are used as previously described to provide secure packing of the elements of the unit.

Figure 40:
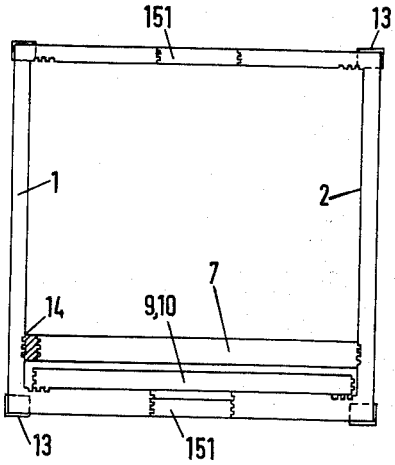
FIG. 40 is a cross-section of a modified container arrangement.
Figure 41:
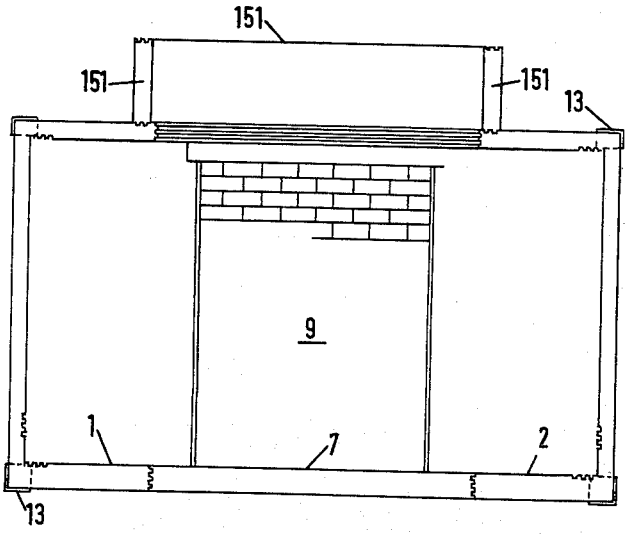
FIG. 41 shows the FIG. 4 arrangement assembled.

It may in some circumstances be desirable for the ceiling "tray" of the assembled unit to be open at the top, e.g. if the unit accommodates an air-conditioning plant. This again involves a different containerized arrangement of the elements e.g. as illustrated in FIG. 40. The wall trays 1, 2 are spaced apart by two side and two end strips 151 which complete the 8 feet square-section container, inside which are packed the floor panel 7, with or without a plant mounted thereon, which retains the door and window panels 9, 10 packed side by side. In the assembled unit, the side panels 151 are erected on the upper edges of the wall trays and the end panels 151 span the wall tray at the ends of the unit to form an open top ceiling tray.

Figure 42:
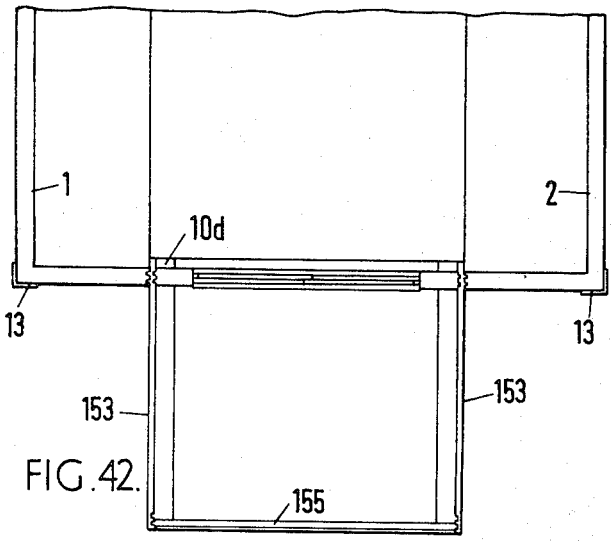
FIGS. 42 and 43 are a plan section and longitudinal section of a balcony of an assembled room unit.
Figure 43:
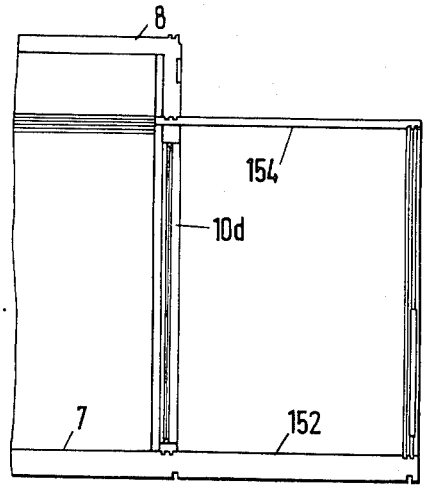

The provision of corridors has already been described. Corridor panels may also be used to form a verandah along the side of the building. The assembled room units may also have balconies, bay windows, porches, (at ground level) provided e.g. by replacement or modification of the door or window panel. By way of example, FIGS. 42 and 43 illustrate a balcony. The window panel 10*d* is slightly narrower and lower than a standard window panel and therefore does not entirely fill the gap formed by the wall and ceiling trays and floor panel. The latter is extended outwards by a panel 152. The spaces between panel 10*d* and the wall trays accommodate balcony side panels 153 and the space between the top of panel 10*d* and ceiling tray 8 accommodates a balcony ceiling panel 154; panels 153 have tongue and groove edge flanges to mate with panels 152 and 154. A balustrade 155 completes the balcony. For transportation an arrangement like that of FIGS. 6 to 8 is used, with the balcony panels and the door panels being packed between the floor panel and ceiling tray. The panel 10*d* of course incorporates a door or french windows or the like; it may be omitted altogether, the balustrade being replaced by a window panel, if desired, to form a bay window, or by a door panel to form a porch.

Alternatively balconies, verandahs, canopies etc. may be suspended from the room units by tie rods.

The invention has hitherto been described mainly with reference to wall trays arranged horizontally. They can however be arranged vertically, as in the case of the elevator already described, to form a multi-story building or part of a building.

Figure 44:
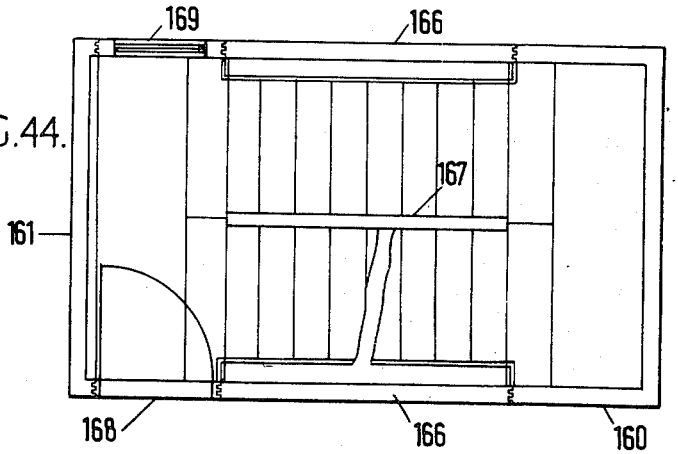
FIGS. 44 and 45 are a plan section and vertical section of a staircase using vertically oriented elements.
Figure 45:
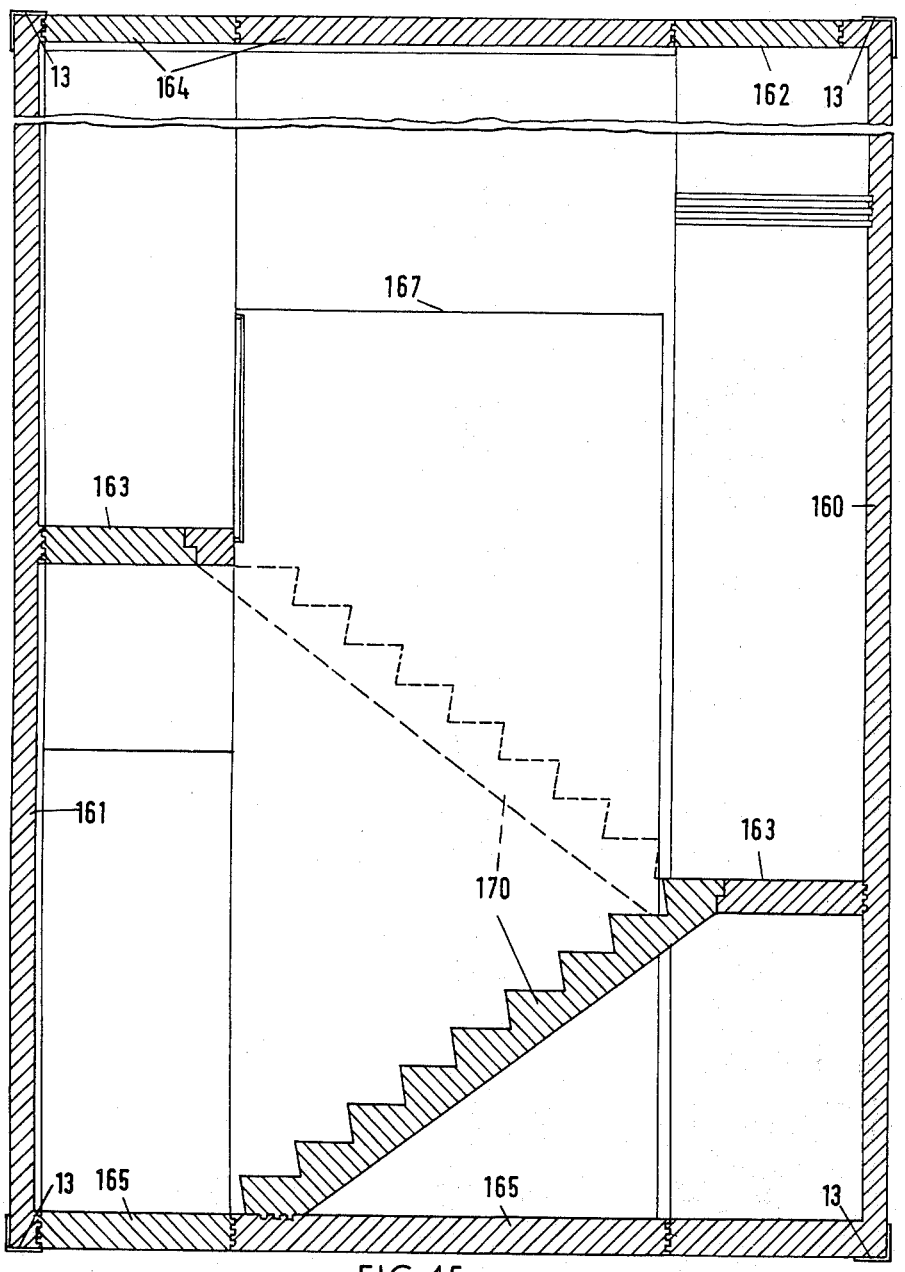

Thus, an alternative staircase arrangement, suitable as a fire-escape stair, is shown in FIGS. 44 and 45. The elements shown when assembled form a two-story stair; when containerized they form a rectangular volume 19 feet 10 1/2 inches long and 8 × 4 feet in cross-section, i.e. half a standard container; a standard container volume therefore provides a four-story stair. The half container is formed by a wall tray 160 and a wall panel 161. The upper and/or lower end of the wall tray may be separable, as panel 162, to provide communication between a lower and an upper two-story stair stacked one on other. The stair is completed by landing panels 163, floor and ceiling panels 164, 165, side wall panels 166, a balustrade panel 167 and door and window panels 168, 169, and four flights 170 of stairs. Panels 164 and 165 are omitted if necessary to give communication between stacked two-story stairs. The panels 163 to 169 and flights 170 are packed inside the half-size container formed by panel 161 and tray 160. In a pair of such containers forming a full-size container volume, one container will contain all the necessary panels 164, 165 and the other will contain the balustrade panels.

Since international standard containers can be up to 40 feet long, a single container can provide wall elements for a building up to 40 feet high.

Any desired number of the wall elements, identical or different in detail and contents, can be placed side by side to form a building of desired size.

This method of construction is particularly convenient for the construction of dwellings, for example town houses.

The building will normally be completed by further elements which may be transported separately, or inside containers formed by the wall elements, or may be assembled with all elements to form assemblies of standard container dimensions.

Elements of different lengths may be employed to form the building. For example, an element 20 feet long will form two stories, and an element 40 feet long will form four stories.

For erection purposes, the container elements are placed vertically with all necessary built-in elements such as staircase, kitchen, bathroom, furniture and fittings. After decontainerization of the floor, window and door panels, which are placed within a container transport, a dwelling unit is assembled comprising the required number of bedrooms and reception areas.

Dwelling units can be erected in the form of detached/ semi detached, terraced (town) houses or maisonettes.

Flexibility of grouping of dwellings with roof terraces may be limited by fastening the dwellings to each other on the module of 8 feet (width of the container).

Figure 47:
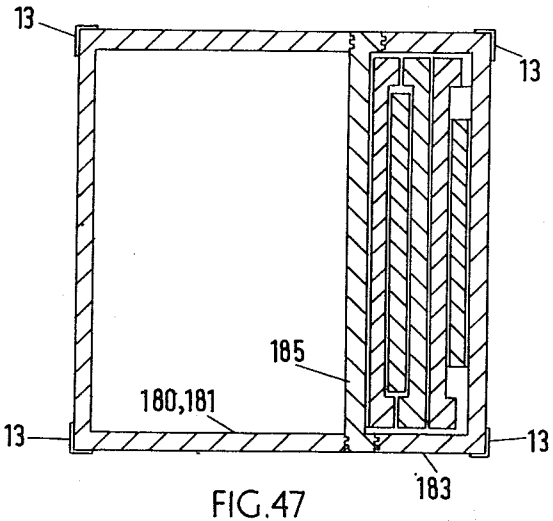
FIGS. 47 and 48 show the manner in which the elements constituting the house are packed together to form containers.
Figure 46:
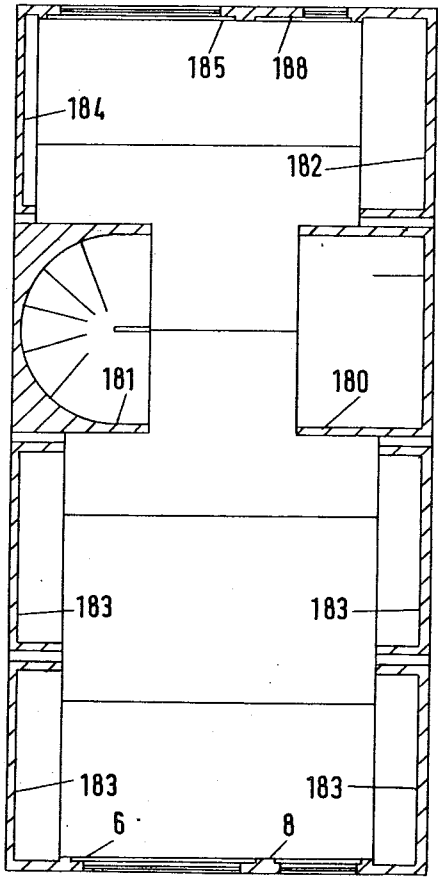
FIG. 46 is a floor plan of a house using vertically oriented elements.
Figure 49:
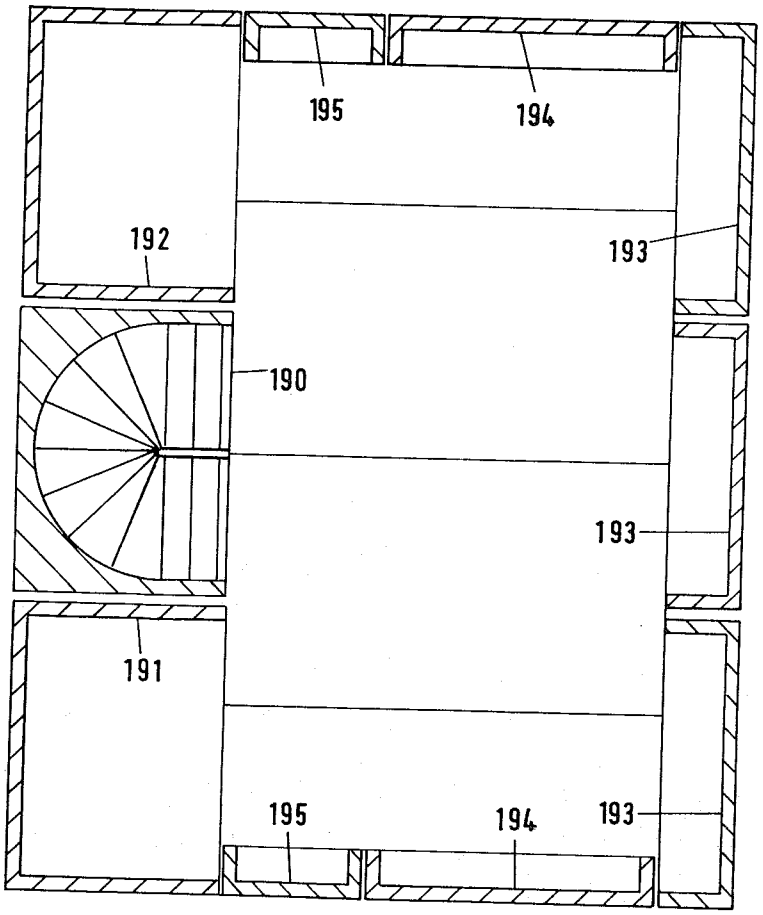
FIG. 49 is a floor plan of a dwelling unit using vertically oriented elements.
Figure 48:
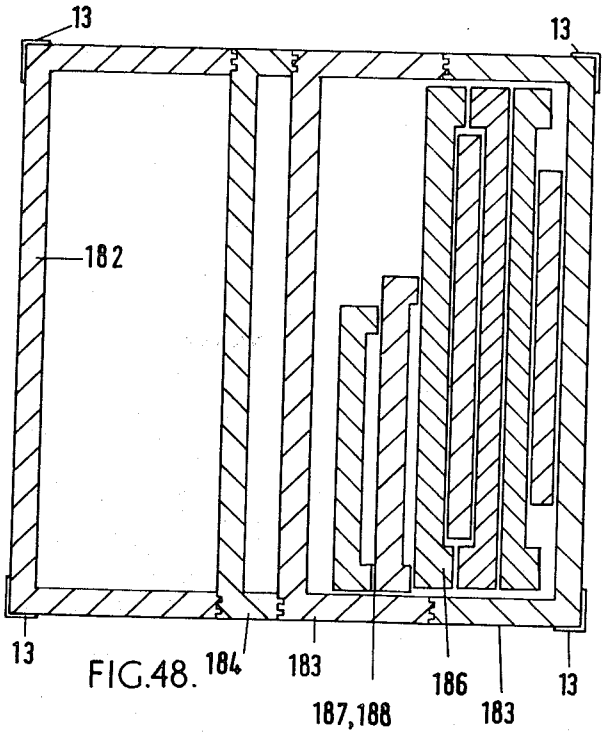

FIGS. 46 to 48 relate to a three-bedroom town house with two stories. The two long side walls of the house consist of eight wall trays of rectangular open-box construction, consisting preferably of glass reinforced plastic on steel frames.

These trays are 20 feet long and 8 feet wide, to conform to international container dimensions. They are erected on end, side by side, and the open side of each faces into the interior of the house.

The number and arrangement of trays can be selected to provide a house of the desired size and internal arrangement. Longer trays can be used to provide a taller house.

In the construction shown, five different kinds of trays are used. A deep tray 180 faces an equally deep tray 181 which contains a prefabricated staircase. The tray 180 contains a prefabricated kitchen at ground floor level, and a prefabricated bathroom at first floor level. All necessary service ducts and connections are incorporated in the trays.

Beside the kitchen/bathroom tray 180 is a deep wall tray 182 which at first floor level incorporates further sanitary facilities, for example a shower and water closet, prefabricated with their service connections and ducts. Facing the tray 182 is a shallow tray 184.

On the other side of the trays 180 and 181, the side walls of the house are completed by four standard trays 183.

The gap between the trays at the front and rear of the house is filled by panels incorporating windows and doors. Floor panels extend horizontally on abutments provided in the wall trays, to form the first floor.

Internally, the house can be arranged in any convenient manner. For example, at ground floor level the space defined by the containers 183 can form a living area and entrance hall, and the space defined by trays 182 and 184 can form a dining area. At first floor level, an internal partition extending from the front rearwards can divide the space defined by the trays 183 into a pair of bedrooms, the space defined by trays 182 and 184 forming a third bedroom, and sanitary facilities either en suite with or separate from the third bedroom. The stairs may be continued up to the roof of the house, which can be of any convenient construction.

During transportation from the factory where they are prefabricated to the erection site, the wall trays and other elements of the house are packed together to form three containers of international standard dimensions. Two containers are arranged as shown in FIG. 47, and the third as shown in FIG. 48.

The container shown in FIG. 47 consists of one of the large trays 180 or 181, one standard tray 183, and sandwiched between these a window panel 185. The edges of the trays 180, 181 and 183 and the panel 185 have mating tongues and grooves, and the trays have at their corners standard container lifting blocks 13; in the assembled house, these lifting blocks are interconnected by connector units to hold the trays together. The eyes are connected to the steel frames of the trays.

The space within the trays 180 or 181 is occupied by the staircase or kitchen and bathroom fittings. The space between the tray 183 and the window panel 185 forms a container in which floor panels 186 are transported.

The third container, shown in FIG. 48, consists of the deep tray 182, the shallow tray 184, and two standard trays 18, face to face, the trays again being provided with mating tongues and grooves. The space within the trays 183 contains further floor panels, and window and door panels 187, 188.

FIGS. 49 to 55 relate to a three bedroom two story dwelling unit which can be used alone, or side by side with or above or below similar units. The unit illustrated consists of a staircase tray 190 flanked by two equally deep trays, of which tray 191 forms a prefabricated kitchen at the lower story level and a prefabricated bathroom at the upper level; the tray 192 may contain prefabricated storage and cupboard space at the lower level and bedroom furniture and fittings at the upper level. Facing these trays are shallower trays 193. The plan of the unit is completed by two window panels 194 and two window and/or door panels 195 internally partitioned may be provided as desired. For example, the space between the trays 190 to 192 and the trays 193 at the lower level may form a living and dining area, the corresponding space at the upper level being divided into two bedrooms and a landing, the third bedroom being in the space defined by the tray 192 and the adjacent panel 195. At the lower level, at least one of the panels 195 incorporates a door; at the upper level, these panels incorporate windows. The panels 194 incorporate windows at both levels. Floor panels 196 extend horizontally between the trays and the panels 194, 195, which are provided with suitable abutments to receive the floor panels.

Figure 50:
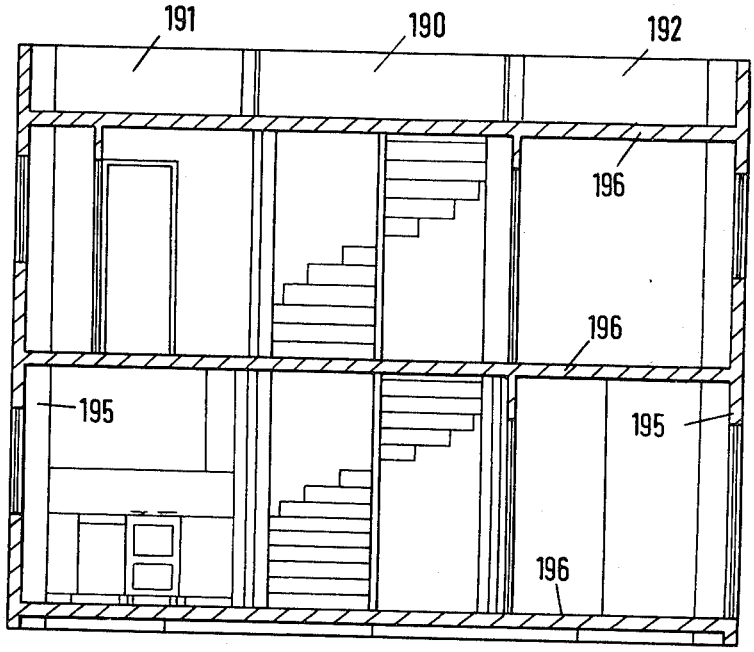
FIGS. 50 and 51 are cross-sections of the dwelling unit.
Figure 51:
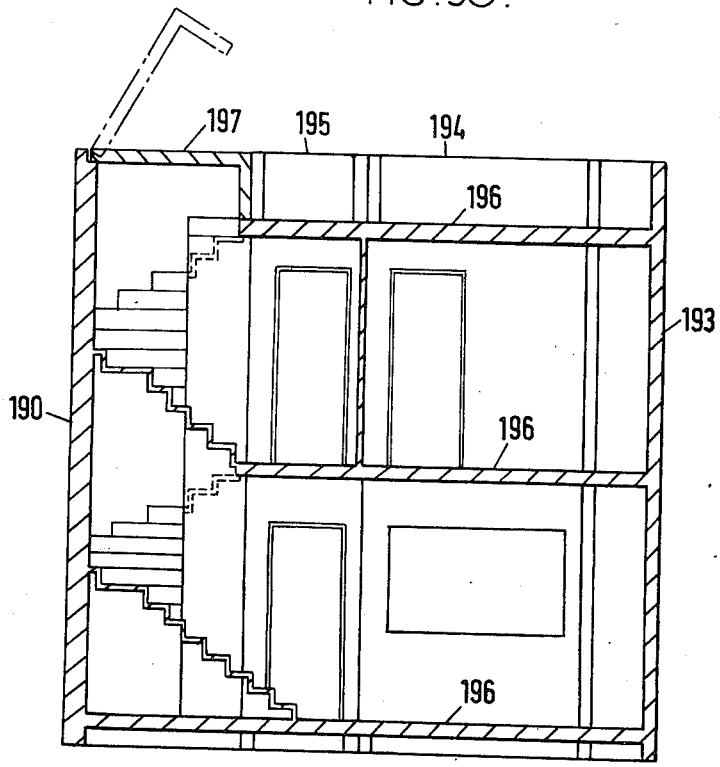
Figure 52:
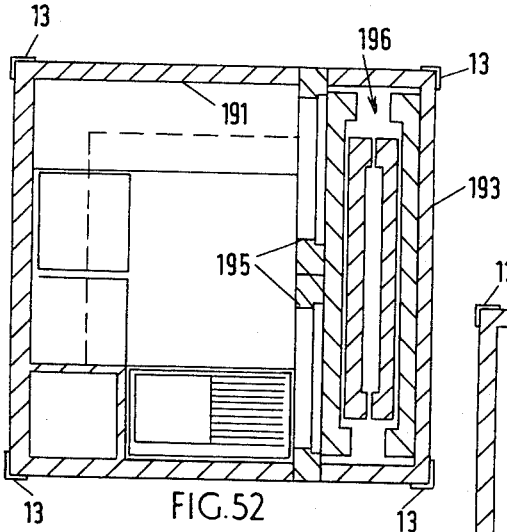
FIGS. 52 to 55 show how the elements of the dwelling unit are packed together to form containers
Figure 53:
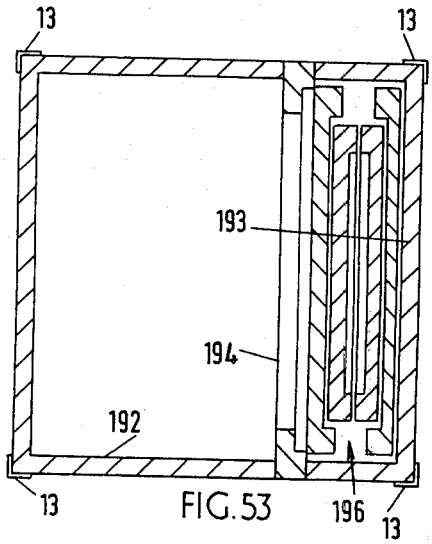
Figure 54:
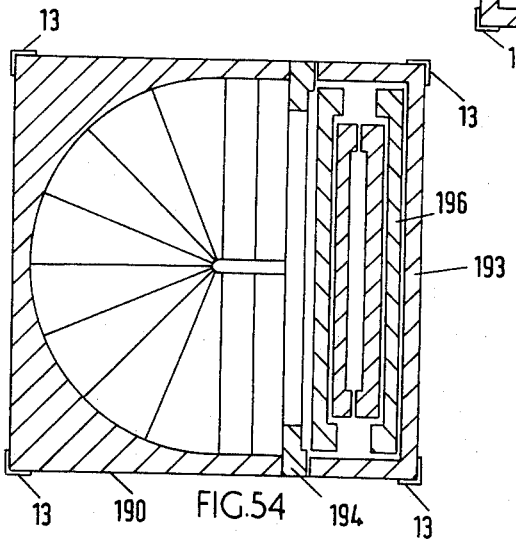
Figure 55:
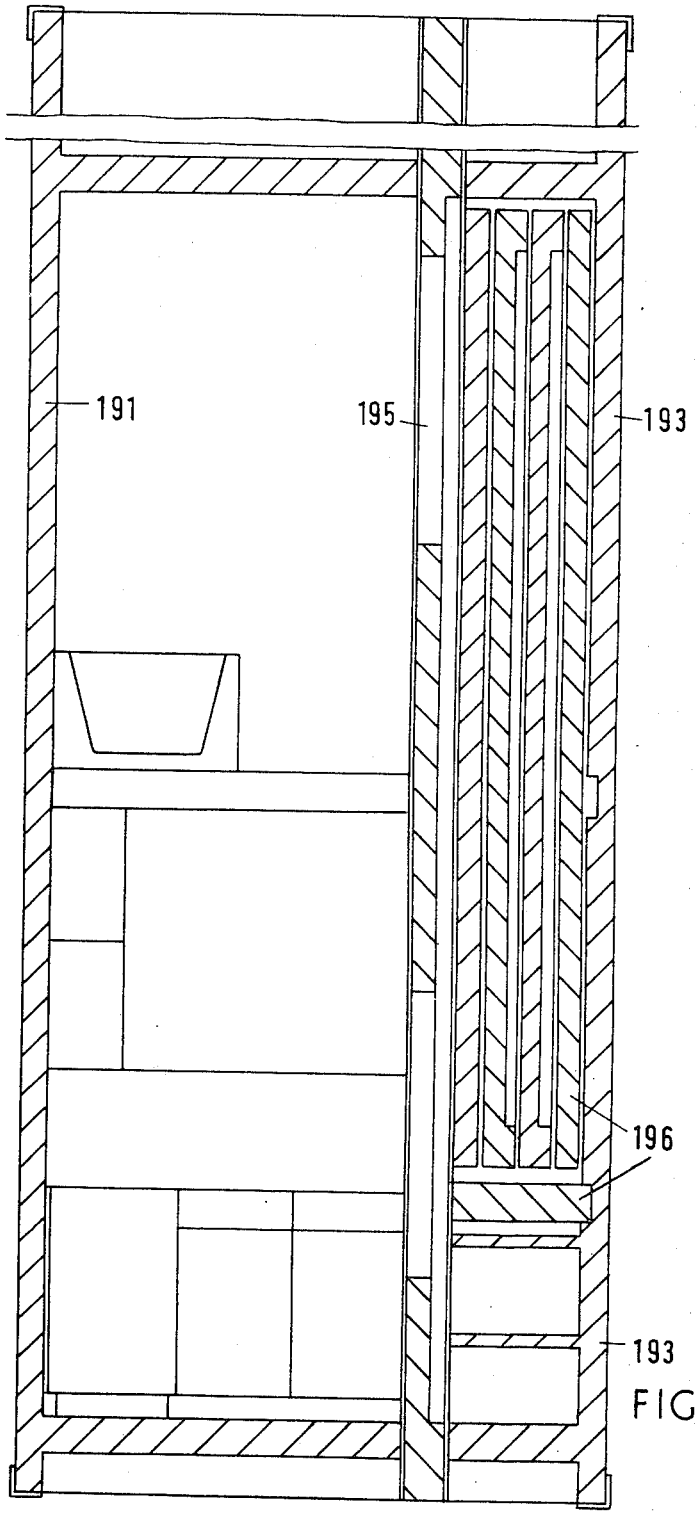

It will be seen from FIGS. 50 and 51 that the open-box construction of the trays does not extend completely to the top and bottom of the trays (which are erected with their length vertical). The top and bottom walls of the open-box construction are spaced from the portions that form the side walls of the dwelling unit, to provide a space below the lower floor for services and a roof terrace at the top thus, a trap 197 may be provided at the top of the stairs.

The trays and panels, for transportation, are packed together to form three containers of international standard dimensions, as shown in FIGS. 52 to 55. Each container consists of one of the deep trays 190, 191, or 192, face to face with one of the trays 193; sandwiched between these trays is either one panel 194 or the two panels 195. The space within the deep tray 190, 191 or 192 is occupied by the prefabricated fittings or furniture, but the space within the tray 193 constitutes a container in which are packed the floor panels. The edges of the trays and the panels 194 195 are provided with tongues and grooves which mate, and lifting eyes are provided at the corners of the trays, which are preferably of glass reinforced plastic construction on a steel frame, as already described.

While the invention is primarily applicable to living accommodation, it is equally applicable to hospitals, offices, and other structures; accordingly "room" herein is to mean any enclosed volume of a building.

It is not essential for the fittings in a wall tray to lie wholly inside the tray profile; for example a bath or a partition might project from the wall tray, provided that the other part of the container is capable of receiving the projecting part, the latter being accordingly nested in the other part during transport.

The present invention has numerous advantages. It allows for "instant" building. The only limitation on the number of rooms erected in a given period, is governed by transport and site conditions.

In shipment abroad, the container not only permits elimination of expensive packing and possible damage, but reduces the volume of the room unit by about 50%, thus reducing shipping costs. Compared with the expense of packing individual items, the cost of the container virtually provides the structure free of charge.

The system very considerably reduces site works, and erection does not depend upon the weather. Weight of the room units being about 10 tons or less permits easy handling and reduces size of foundations.

The cost of the container and fittings is predetermined, thus permitting much more accurate estimating.

The container system permits detailed planning, and minimum use of skilled site labor which is required mainly for connections.

By using this form of building, the developer or purchaser gets the advantage of early utilization of the structure.

Depending on the number of units required, the purchaser is in a position to make his own selection of fittings and decoration to be incorporated in the rooms.

In this last respect, my system is more flexible than those using, e.g. pre-molded sanitary fixtures integral with the walls or floor; the purchaser can choose his own fixtures.

I claim:

1. A room unit comprising prefabricated rectangular tray-like wall elements forming a closed rectangular container for transportation of furniture of the room unit; said furniture being prefabricated in said wall elements; generally strip-like prefabricated elements forming together with said wall elements at least one room of greater volume than the container, and means in said elements for securing said elements together to form said container; at least said wall elements being load-bearing structural members; wherein at least some of the elements have tongue and groove portions arranged and adapted to interfit with corresponding portions of other elements to locate the elements during transportation and when assembled to form said room.

2. In combination a plurality of room units, each comprising prefabricated rectangular tray-like wall elements forming a closed rectangular container for transportation of furniture of the room unit; said furniture being prefabricated in said wall elements; generally strip-like prefabricated elements forming together with said wall elements at least one room of greater volume than the container, and means in said elements for securing said elements together to form said container; at least said wall elements being load-bearing structural members assembled and forming a building, and at least one prefabricated foundation and services unit comprising a channel-section member incorporating service conduits and junction units and providing a space for access to the service conduits and junction units.

* * * * *